US008827183B2

(12) United States Patent
Jones

(10) Patent No.: US 8,827,183 B2
(45) Date of Patent: Sep. 9, 2014

(54) DUAL APERTURE SPRAY TIP CUP GUN

(75) Inventor: Michael B. Jones, Excelsior, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 462 days.

(21) Appl. No.: 12/327,959

(22) Filed: Dec. 4, 2008

(65) Prior Publication Data

US 2009/0145980 A1 Jun. 11, 2009

Related U.S. Application Data

(60) Provisional application No. 60/992,603, filed on Dec. 5, 2007.

(51) Int. Cl.

| | |
|---|---|
| ***B05B 9/04*** | (2006.01) |
| ***B05B 1/34*** | (2006.01) |
| ***B05B 9/08*** | (2006.01) |
| ***B05B 1/04*** | (2006.01) |
| ***B05B 1/14*** | (2006.01) |
| *B05B 7/08* | (2006.01) |

(52) U.S. Cl.

CPC ..... *B05B 9/0855* (2013.01); *B05B 1/3436* (2013.01); *B05B 9/0426* (2013.01); *B05B 9/0409* (2013.01); *B05B 7/0846* (2013.01); *B05B 1/046* (2013.01); *B05B 1/14* (2013.01)

USPC ..... 239/332; 239/333; 239/399; 239/404; 239/407; 239/412; 239/463; 239/468; 239/491; 239/492; 239/562; 239/568

(58) Field of Classification Search

USPC ..... 239/329, 331–333, 406, 407–410, 412, 239/413, 463, 464, 468, 486, 490, 491, 492, 239/494, 497, 562–565, 568, 399, 401, 403, 239/404

See application file for complete search history.

(56) References Cited

U.S. PATENT DOCUMENTS

| | | | | |
|---|---|---|---|---|
| 2,704,690 | A * | 3/1955 | Eichenauer | 239/127 |
| 4,579,286 | A | 4/1986 | Stoudt | |

(Continued)

FOREIGN PATENT DOCUMENTS

| | | |
|---|---|---|
| CN | 1187150 A | 7/1998 |
| DE | 871429 | 3/1953 |

(Continued)

OTHER PUBLICATIONS

International Search Report and Written Opinion issued in PCT/US2008/085478, mailed Mar. 2, 2010, 21 pages.

(Continued)

*Primary Examiner* — Christopher Kim

(74) *Attorney, Agent, or Firm* — Christopher J. Volkmann; Kelly, Holt & Christenson, PLLC

(57) ABSTRACT

A hand-held paint spray gun apparatus having a paint reservoir on the gun and reciprocating piston driven by a motor in the hand-held paint spray gun, the gun having a multiple orifice spray tip with a pair of apertures emitting generally fan or cone shaped overlapping spray patterns. A locking nut retains the cylinder to a motor frame and a frame carries the spray tip, with one of the nut and frame having a corrugated surface and the other of the locking nut and the spray tip frame having a plurality of protrusions engaging the corrugated surface. The protrusions are spaced apart circumferentially from each other and with respect to the spacing of a plurality of troughs and crests in the corrugated surface such that only one protrusion at a time is nested in a trough of the corrugated surface.

29 Claims, 50 Drawing Sheets

(56) References Cited

U.S. PATENT DOCUMENTS

| | | | |
|---|---|---|---|
| 4,842,203 | A | 6/1989 | Kuhn et al. |
| 4,884,742 | A | 12/1989 | Bekius et al. |
| 5,060,869 | A | 10/1991 | Bekius |
| 5,096,746 | A | 3/1992 | Strizki |
| 5,202,381 | A | 4/1993 | Parker |
| 5,232,739 | A | 8/1993 | Strizki |
| 5,366,162 | A | 11/1994 | Strizki |
| 5,642,860 | A | 7/1997 | Bush et al. |
| 5,643,993 | A | 7/1997 | Guerin |
| 6,465,047 | B1 | 10/2002 | Scott et al. |
| 6,531,538 | B1 | 3/2003 | Weitzel et al. |
| 6,655,606 | B2 | 12/2003 | Earl |
| 6,818,050 | B1 | 11/2004 | Nyssen |
| 2002/0082319 | A1 | 6/2002 | Zhao et al. |
| 2002/0129767 | A1 | 9/2002 | Czerwonka |
| 2007/0129469 | A1 | 6/2007 | Befurt et al. |

FOREIGN PATENT DOCUMENTS

| | | | |
|---|---|---|---|
| DE | 920 059 | C | 11/1954 |
| DE | 920059 | | 11/1954 |
| DE | 101 13 227 | | 9/2002 |
| DE | 203 13 201 | | 11/2003 |
| DE | 103 15 483 | | 11/2004 |
| DE | 203 20 747 | | 3/2005 |
| EP | 0 728 154 | | 8/1996 |
| EP | 1 611 210 | | 1/2006 |
| EP | 1 618 155 | | 1/2006 |
| JP | 59-206064 | A | 11/1984 |
| JP | 59-206065 | A | 11/1984 |
| JP | 07-275751 | A | 10/1995 |
| WO | WO 98/01229 | A | 1/1998 |
| WO | WO 2004/087821 | | 10/2004 |
| WO | WO 2004/087822 | | 10/2004 |

OTHER PUBLICATIONS

Declaration of Joseph W. Kieffer, signed Oct. 11, 2010, 2 pages, with Exhibits 1-4 identified in the Declaration.

Third Chinese Office Action for Chinese Application No. 200880126209.5, dated Apr. 15, 2013, 10 pages.

First Office Action from Chinese Patent Application No. 200880126209.5, dated Apr. 16, 2012, 9 pages.

Second Chinese Office Action for Chinese Application No. 200880126209.5, dated Nov. 30, 2012, 10 pages.

Examiner's Report for European Patent Application No. 08 859 209.2 dated Dec. 14, 2011.

Communication pursuant to Article 94(3) EPC for European Patent Application No. 08 859 209.2-2425, dated Nov. 5, 2012, 6 pages.

Fourth Chinese Office Action for Chinese Application No. 200880126209.5, dated Jul. 19, 2013, 5 pages.

Examiner's Report for Australian patent application No. 2008335449, dated Oct. 17, 2011. 2 pages.

* cited by examiner

DUAL APERTURE SPRAY TIP CUP GUN

CROSS REFERENCE TO RELATED APPLICATION

This application claims the benefit of U.S. Provisional Application 60/992,603, filed Dec. 5, 2007, the entire contents of which are hereby expressly incorporated by reference.

TECHNICAL FIELD

This invention relates to the field of hand-held paint spray guns which have a reciprocating piston to pressurize paint for atomization.

BACKGROUND

In the past, hand-held paint spray guns, sometimes known as "cup guns" utilized a single orifice spray tip to atomize paint for spraying. The atomization pattern delivered by such tips were characterized by a relatively gradual transition in spray pattern from dense coverage (analogous to the "umbra" of a shadow) in the center of the spray pattern to sparse coverage (analogous to a "penumbra") in the peripheral region of the spray pattern. Such a gradually decreasing coverage spray pattern is undesirable since it has a poorly defined boundary between "coverage" and "no coverage," causing either overspray beyond the desired (dense) coverage or incomplete or sparse coverage where dense coverage is desired. Because the dense central coverage is delivered concurrently with the sparse peripheral coverage, it has heretofore been necessary to mask a relatively wide region adjacent to the area desired to be spray painted, because of the gradually decreasing density in the peripheral region of the spray pattern. In addition, such prior art atomization patterns were also characterized by the presence of undesirably small sized atomized particles (sometimes called "fines") in the peripheral region ("penumbra") of prior art spray patterns. Such uncombined fines in the peripheral region of the spray pattern are undesirable, since they are prone to cure or dry before reaching the surface to be coated, becoming undesirable overspray particles that do not adhere the surface being treated, resulting in waste product of the material being sprayed, and thus can be a contributing factor to decrease the transfer efficiency of the paint spraying process.

One prior art system, Nespri-TEC, uses airless paint spray equipment to apply a special coating material. Equipment for that system is offered by J. Wagner GmbH of Otto-Lilinethal Strasse 18, 88677 Markdorf, Germany, under the trademark NESPRAY. Coating materials for that system are offered under the trademarks AmphiSilan, Nespri FiXX, and Nespri Silan by Caparol Farben Lacke Bautenschutz GmbH of Rossdofer Strass 50, 64372 Ober-Ramstadt, Berlin, Germany. However the Nespri-TEC system differs from the present invention in that it requires special coating material that, in turn, requires the equipment to heat the coating material to control the viscosity. The present invention does not require any special thinners and does not require any special coating material. Conventional paint (and similar conventional coating materials) can be used with the present invention. In addition, the coating material does not need to be heated in the practice of the present invention, unlike the prior art Nespri-TEC system. Finally, the present invention may be practiced with non-converging centerline spray patterns, as well as with converging centerline spray patterns. The NESPRAY equipment has only converging centerline spray patterns.

The present invention also overcomes the shortcomings of conventional prior art cup guns by providing a more sharply defined spray pattern, decreasing relatively rapidly from dense coverage in the central region to no coverage at the periphery of the spray pattern delivered by the present invention. The present invention increases the overall proportion of "fines" in the central region of the spray pattern, and at the same time reduces the proportion of fines in the peripheral region. It is to be understood that fines present in the central region effectively aid the coating process by recombining to form larger atomization particles in the central region of the spray pattern using the present invention. The present invention thus increases the transfer efficiency of and reduces waste products from the spraying process.

SUMMARY

The present invention includes a dual aperture spray tip in combination with a hand-held paint spray gun of the type having a reciprocating piston in the gun to pressurize the paint. The dual aperture spray tip has a pair of orifices, each delivering a spray pattern which may be characterized by a central axis. In one embodiment of the present invention, the central axes are angled towards each other to provide overlapping patterns. In another embodiment of the present invention, the central axes may be parallel to each other. In still another embodiment, the central axes may be angled slightly away from each other.

The present invention provides for overlapping spray patterns, which may be fan shaped or cone shaped. The overlapping patterns provide a smaller peripheral transition region from full coverage to no coverage on a target surface being coated using the present invention. Having a smaller transition region means the spray pattern arriving on the surface to be coated is more sharply defined.

The present invention may be practiced with round aperture spray tips or with "cat-eye shaped apertures or orifices.

In another aspect, the present invention includes a spray tip guard and a key secured to the spray tip guard, wherein the key has a non-circular aperture closely interfitting a corresponding non-circular projection on the holder such that the holder and spray tips can be rotated by rotating the spray tip guard.

In another aspect, the present invention includes a locking nut retaining the cylinder to the reciprocating motor, wherein one of the locking nut and spray tip frame has a corrugated surface and the other of the locking nut and the spray tip frame has a plurality of protrusions engaging the corrugated surface.

In this aspect, the plurality of protrusions are spaced apart circumferentially from each other and with respect to the spacing of undulations or waves forming the corrugated surface such that only one protrusion at a time is nested in a valley or trough of the corrugated surface, while the remaining protrusions contact the corrugated surface at a slope between a trough and a crest or ridge of the corrugated surface.

In one embodiment, the present invention includes a plurality of three protrusions, with one protrusion will coming to rest in a valley, while one other protrusion will rest on an upward slope between a trough and a crest, and the third protrusion will rest on a downward slope between a crest and a trough. The spray tip orifices are located in a spray tip subassembly carried in a spray tip frame which is axially secured to a spray tip guard while a limited rotational movement between the spray tip guard and the spray tip frame is permitted, to enable orientation of the fan pattern emitted from the spray tip subassembly. The interengagement of the protrusions and corrugated surface provide a form of increased frictional contact between the locking nut and the frame carrying the spray tip subassembly to provide additional security to prevent inadvertent loosening of the frame when a user rotates the spray tip guard (in an unthreading direction) to rotationally position the fan pattern to a desired orientation.

In another aspect of the present invention, a plurality of round orifices or apertures may be used in the spray tip. In this embodiment, the orifices provide cone-shaped spray or atomization patterns which overlap each other to provide a combined spray pattern having a small (or narrow) transition region around the periphery of the full coverage of the spray pattern as it fades to no coverage on the surface to be coated.

DETAILED DESCRIPTION

Figure 1:
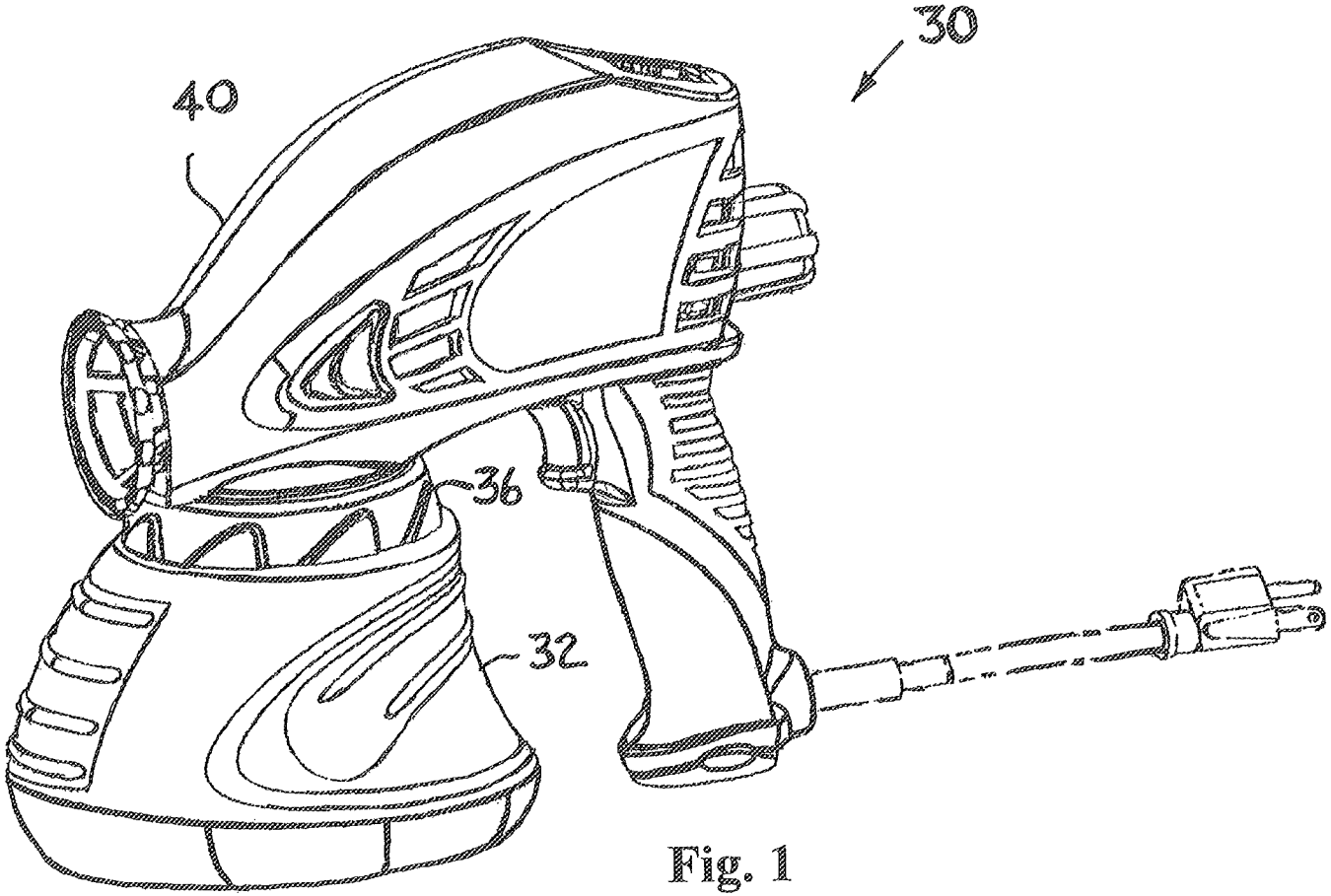
FIG. 1 is a perspective view of one example of a hand-held paint spray gun useful in the practice of the present invention.
Figure 2:
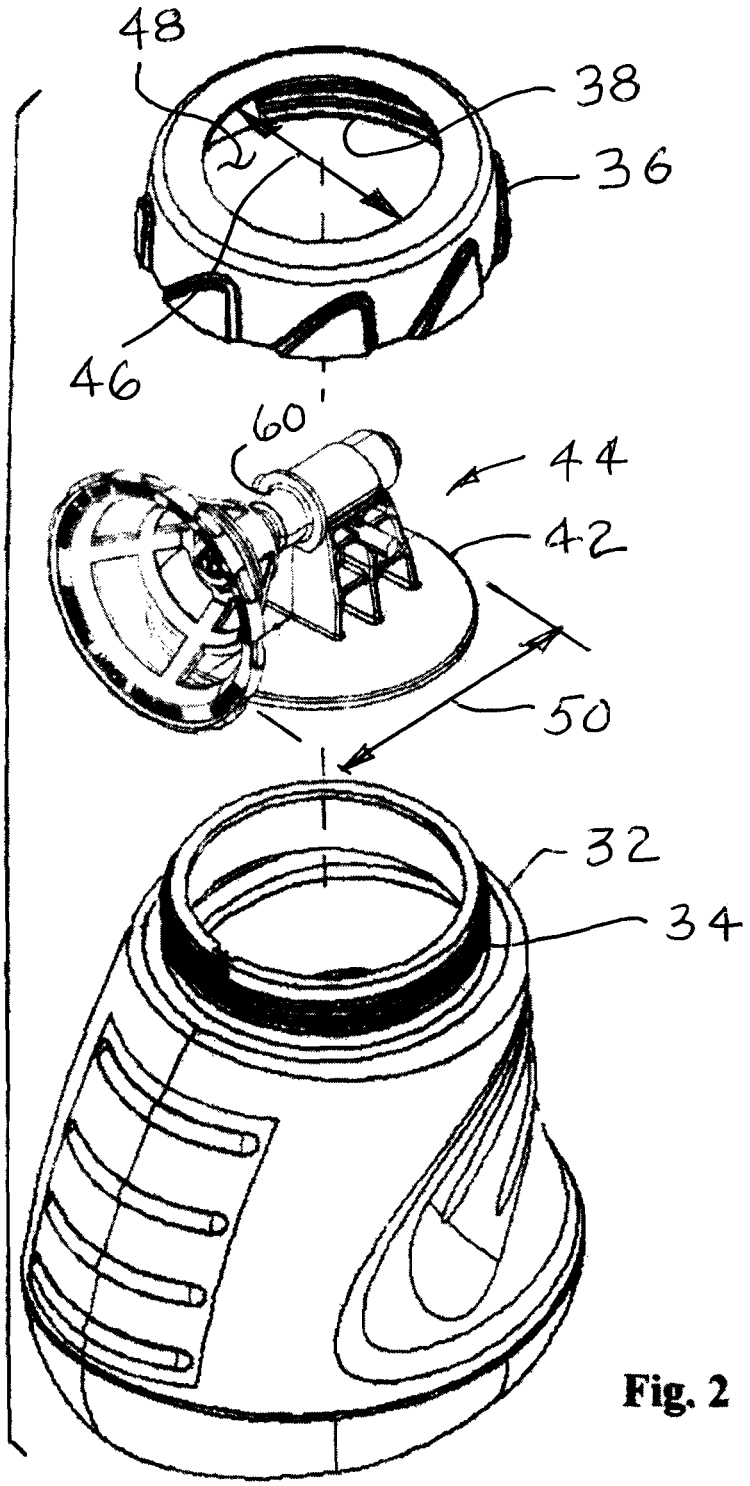
FIG. 2 is an exploded view of some of the parts of the paint spray gun shown in FIG. 1.

Referring now to the Figures, and most particularly to FIG. 1, a first embodiment of a paint spray gun useful in the practice of the present invention may be seen. Gun 30 is shown with a paint reservoir 32, often known as a "paint cup" attached thereto. The gun 30 (with or without the reservoir) is often referred to as a "cup gun." As used herein, "cup gun" refers to a hand-held paint spray gun having an arrangement for directly mounting the paint reservoir 32 on the gun 30. As may be seen most clearly in FIG. 2, the paint cup 32 may have external threads 34 received in a ring 36 having internal threads 38 with the ring 36 being an independent part (as shown here), or (alternatively) the internal threads 38 may be formed as a part of a gun housing 40. When the ring version of attachment of the paint cup is used, the ring 36 is received over a circular flange 42 of a cylinder housing 44, it being understood that a diameter 46 of an aperture 48 in the ring 36 is smaller than a diameter 50 of flange 42.

Figure 5:
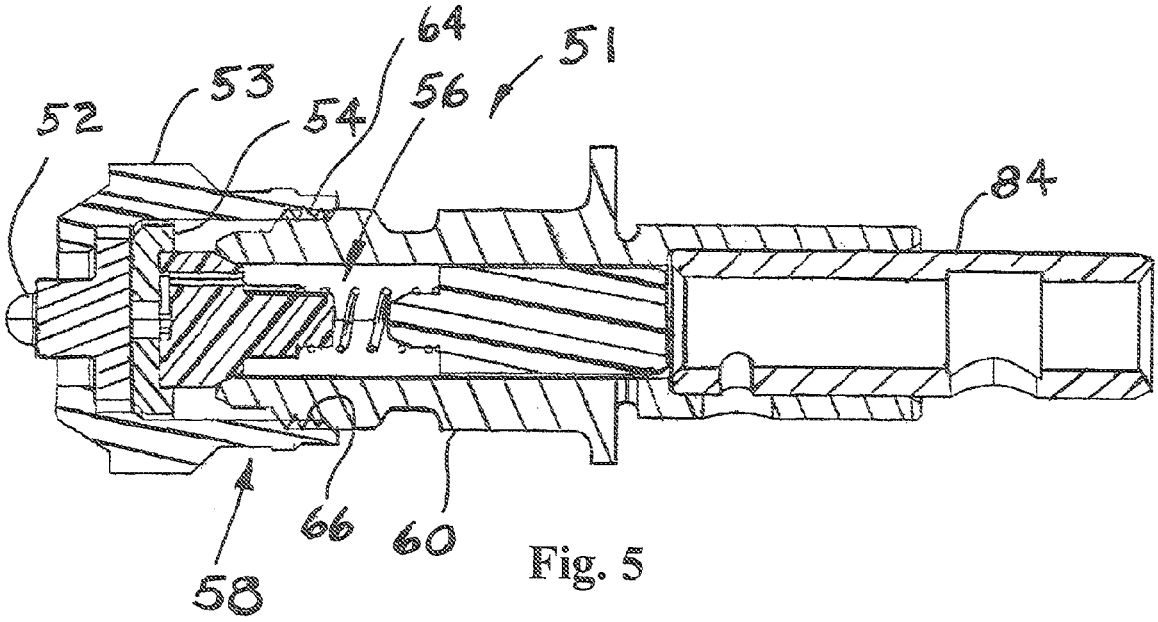
FIG. 5 is a side section view taken along line V-V of the spray tip subassembly of FIG. 4, along with associated parts from FIG. 3.
Figure 6:
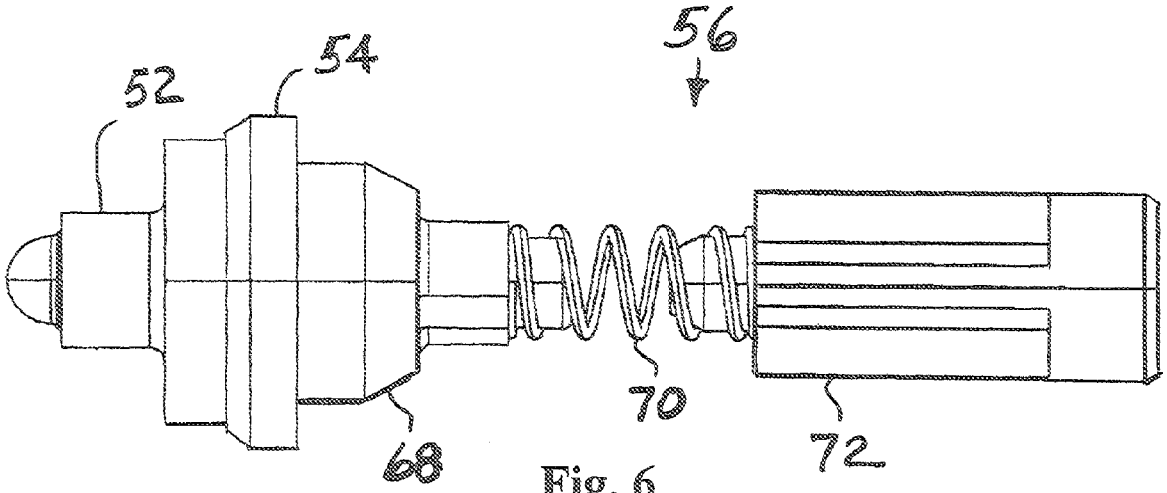
FIG. 6 is a side view of a dual orifice spray tip, swirl chamber plate, swirl valve, spring and check valve from FIG. 5.
Figure 7:
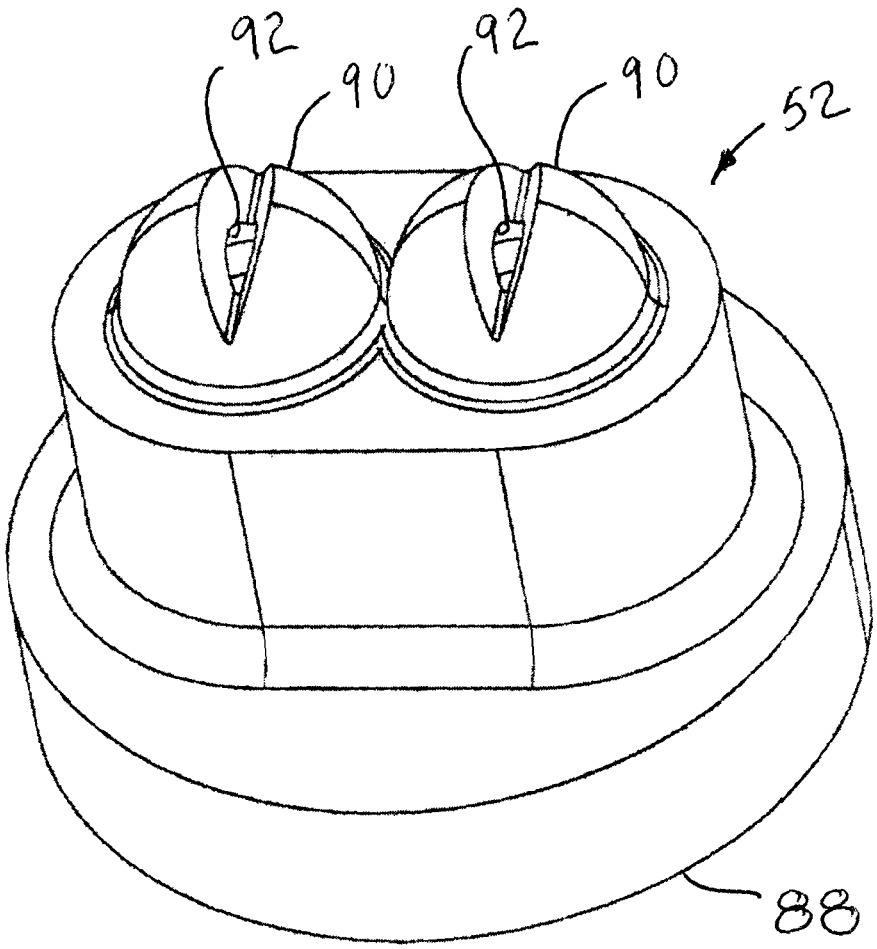
FIG. 7 is an enlarged perspective view of a dual orifice spray tip useful in the practice of the present invention.
Figure 8:
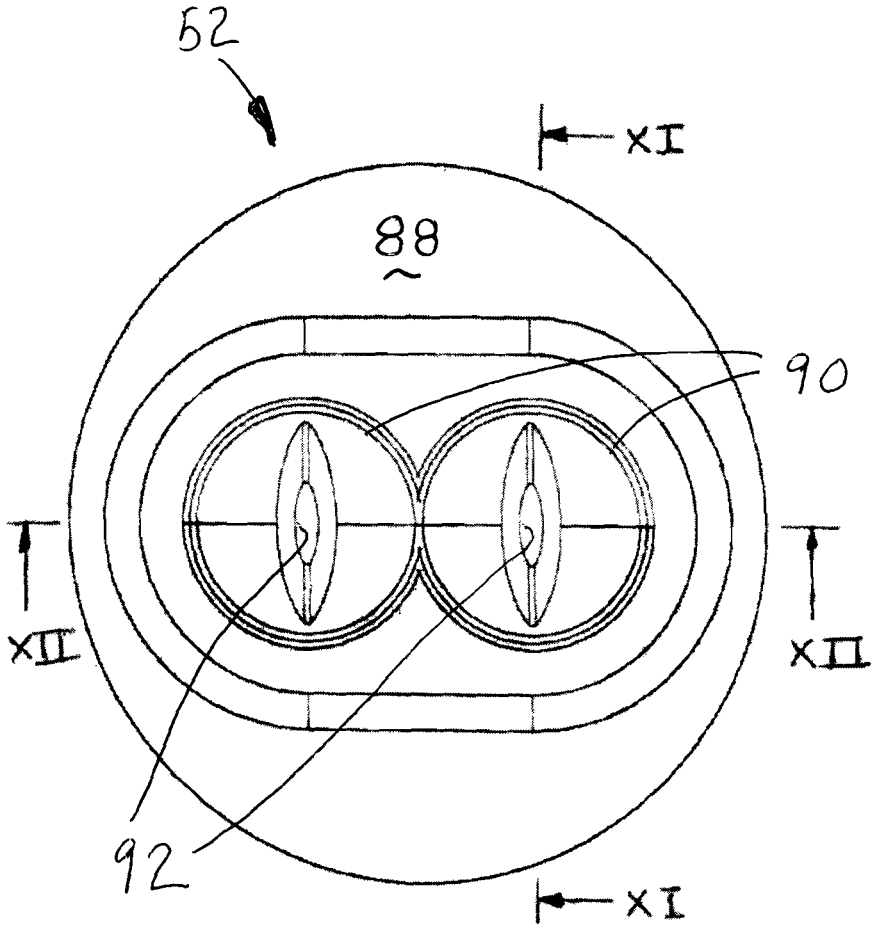
FIG. 8 is a front view of the spray tip of FIG. 7.

Referring now also to FIGS. 3-6, and initially most particularly to FIG. 5, a spray tip subassembly 51 may be seen. Subassembly 51 includes a dual orifice spray tip 52 with a mounting nut 53 to secure the spray tip 52 and a swirl valve subassembly 56 to a front 58 of a piston cylinder 60 carried in the cylinder housing 44. External threads 64 are located on the front 58 of the cylinder 60. Internal threads 66 are located in the nut 53, as may be seen in FIG. 5. FIG. 6 shows the dual orifice spray tip 52 together with the swirl valve subassembly 56. In this embodiment, subassembly 56 includes a swirl chamber adapter 54, a swirl valve 68, a spring 70, and a check valve 72. It is to be understood that valve 68, spring 70 and check valve 72 may be the same as prior art versions of these parts.

Figure 3:
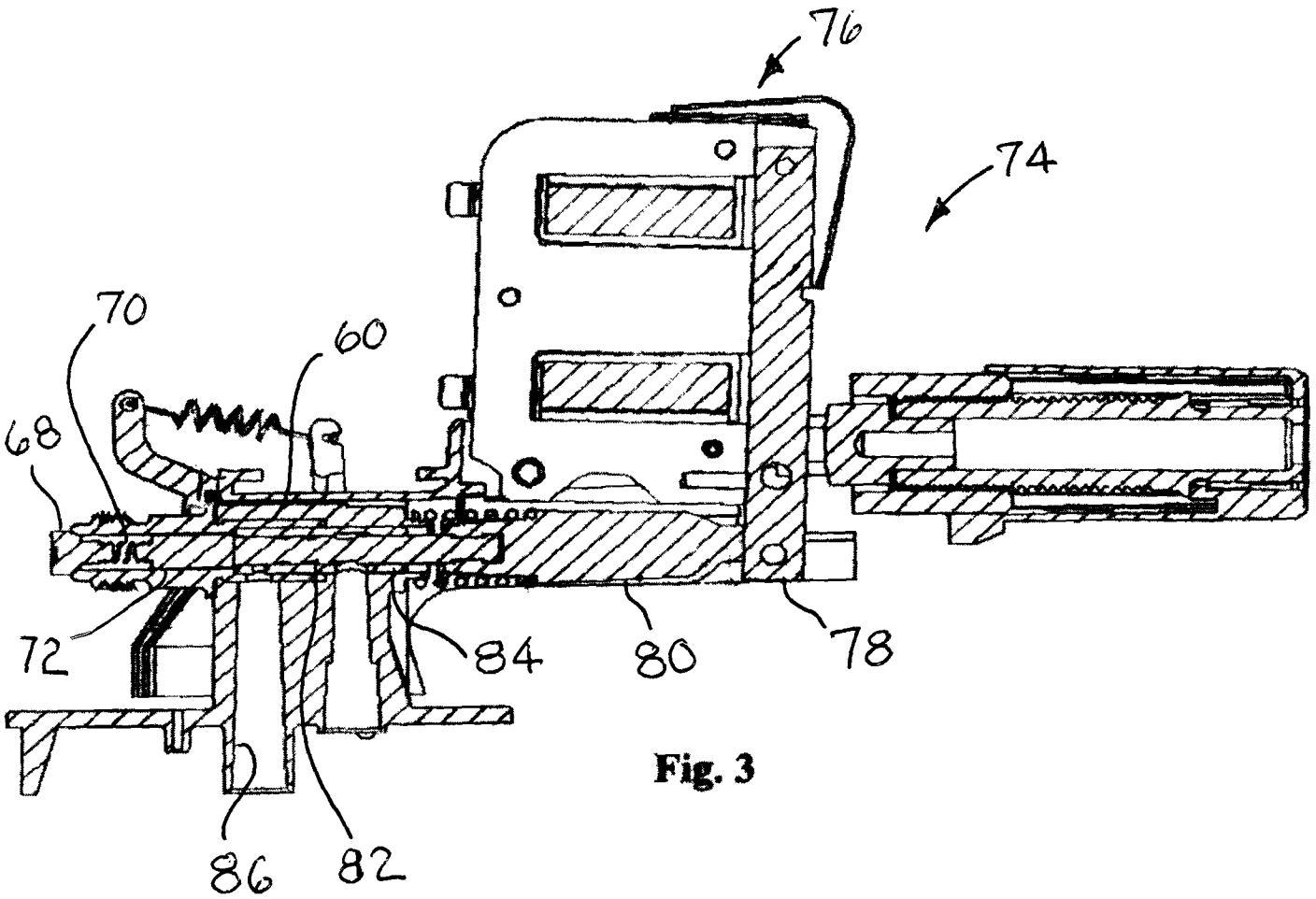
FIG. 3 is a side section view of certain internal parts of the paint spray gun shown in FIG. 1 to illustrate the operation of the spray gun of FIG. 1.
Figure 4:
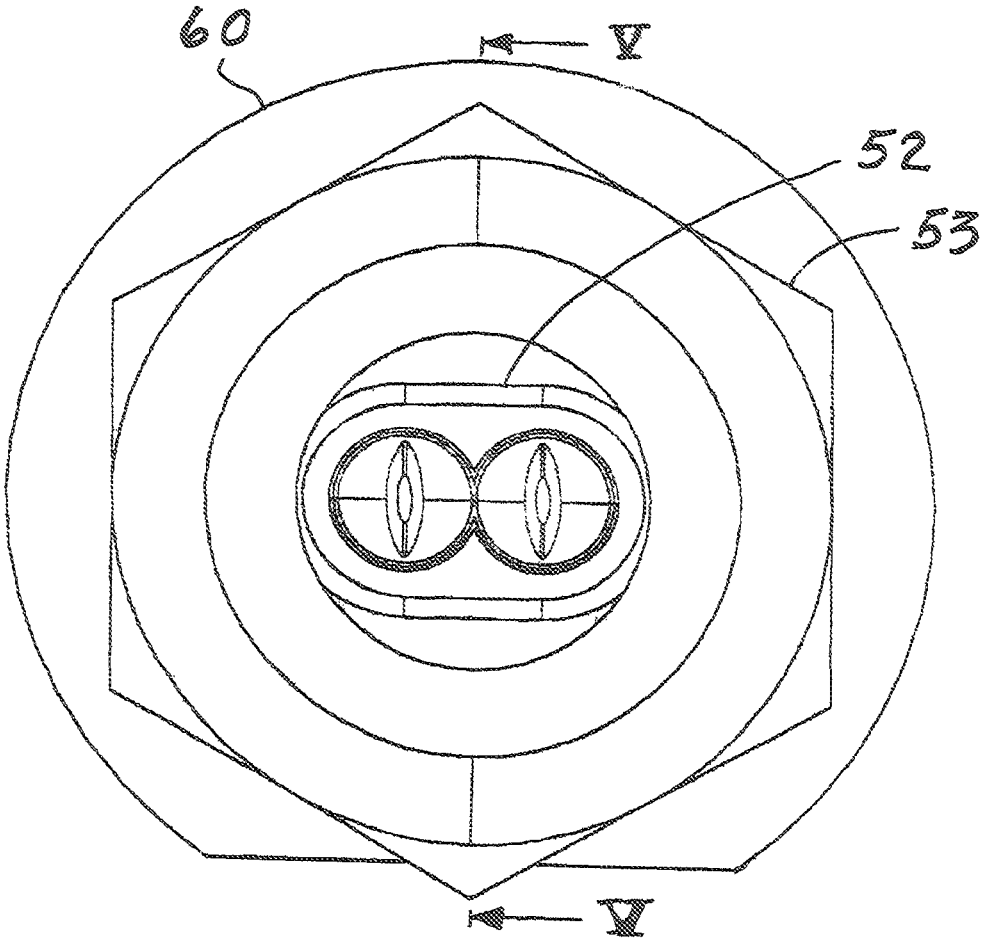
FIG. 4 is a front view of a spray tip subassembly from FIG. 2.

Referring now most particularly to FIG. 3, a side section view of parts of an internal assembly 74 of the cup gun 30 may be seen. An E-I lamination motor 76 has a reciprocating member 78 driving a plunger 80 connected to a piston 82, which reciprocates in a sleeve 84 secured in cylinder 60. Paint is drawn up through a siphon tube (not shown) in a channel 86 and delivered past the check valve 72 to the swirl valve 68.

It is to be understood that the "cup gun" aspect of the present invention may be characterized as one in which the paint pumping piston is located in the hand-held paint spray gun (in contrast to those painting systems have a paint pump with a piston remote from a hand-held paint spray gun, with the pump connected to the gun by a flexible hose).

Referring now to FIGS. 7-12, the dual orifice spray tip 52 may be seen in more detail. Dual orifice spray tip 52 has a base region 88 that is preferably circular (as may be seen most clearly in FIGS. 8 and 9) to permit rotation of the spray tip 52 in a manner the same or similar to that shown in U.S. Pat. No. 5,060,869, titled Ceramic Flat Spray Tip assigned to the same assignee as the present invention. The entire contents of U.S. Pat. No. 5,060,869 are hereby expressly incorporated by reference. The dual orifice spray tip 52 has a pair of domed outlet regions 90, each with an oval or "cat-eye" shaped aperture 92 therein. Each aperture provides a fan shaped oval or elliptical spray pattern aligned with a centerline passing through the center of the ellipse-shaped spray pattern delivered by that aperture. In the practice of the present invention using this embodiment the two apertures are arranged to provide that the centerlines of the spray patterns initially converge towards each other. One preferred angle of convergence (illustrated by FIG. 27) is three degrees. It is, however, to be understood that the present invention may be practiced with other convergence angles, depending upon (in part) the distance between the apertures in the spray tip. Converging the spray patterns has been found to reduce the fines that otherwise would result, and provides a more sharply defined spray pattern, with a relatively rapid change (or "penumbra") from dense coverage to no coverage at the periphery of the combined spray pattern delivered by the two apertures. In an alternative embodiment described infra, the present invention may be practiced using spray patterns aligned with centerlines that are parallel to each other.

The two domed outlet regions 90 are each connected to the base region 88 by a transition region 94, having a pair of through bores 96, each providing fluid communication from respective inlet apertures 98 through the base region 88 and the transition region 94 to the respective apertures 92 in the domed outlet regions 90. Each bore 96 may be tapered, with a cross section decreasing from inlet to outlet. The dual orifice spray tip 52 may be made of ceramic or carbide or other similar materials, as desired.

Figure 13:
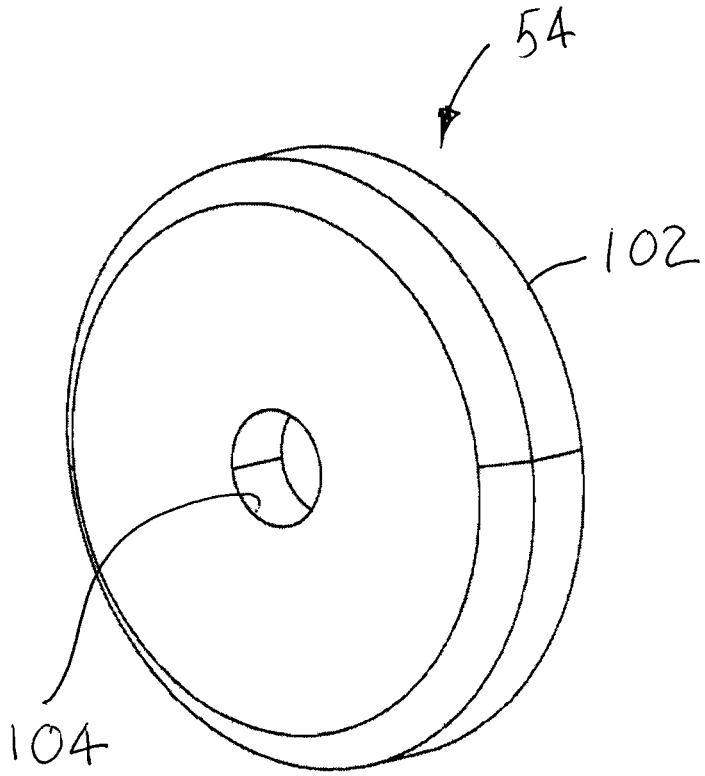
FIG. 13 is a perspective view of the swirl chamber plate from FIG. 6.
Figure 14:
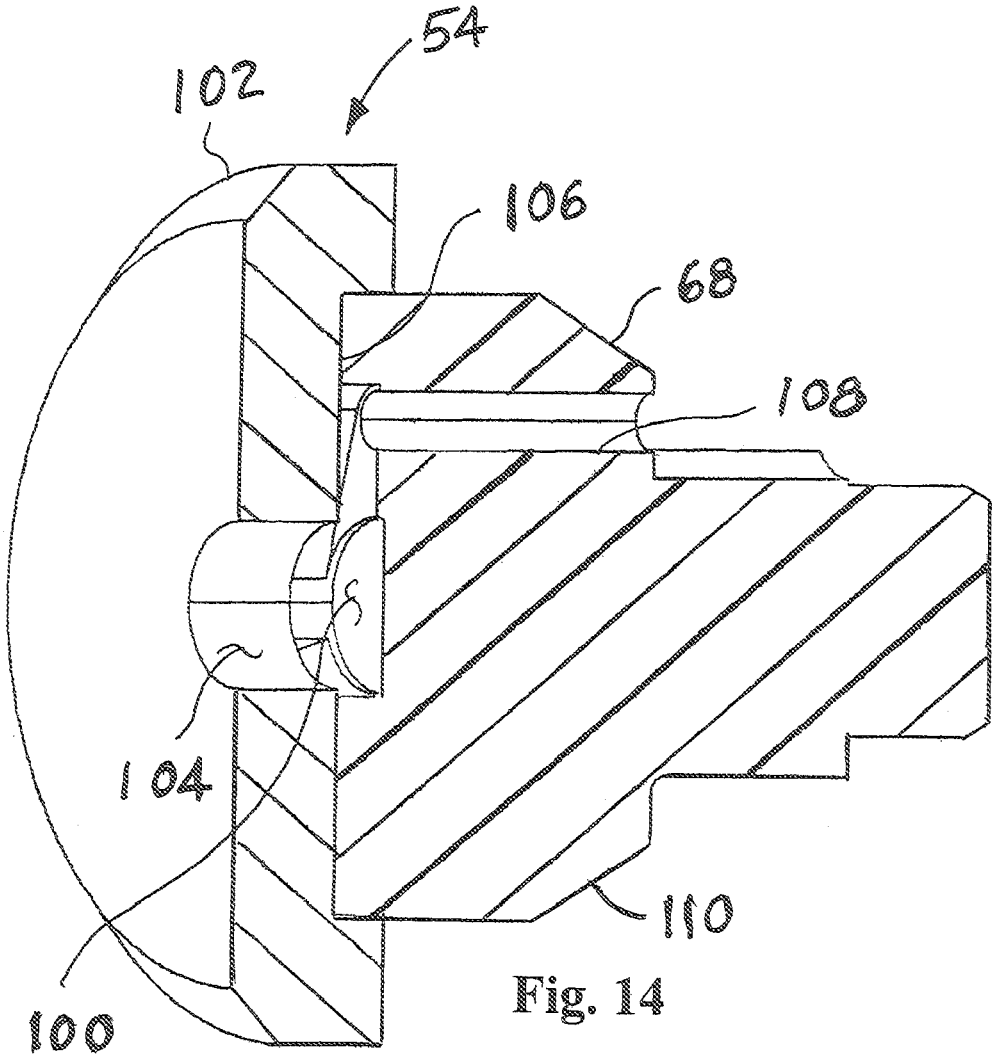
FIG. 14 is a perspective view in section of the swirl chamber plate from FIG. 6 along with a perspective view in section of the swirl valve from FIG. 6.
Figure 15:
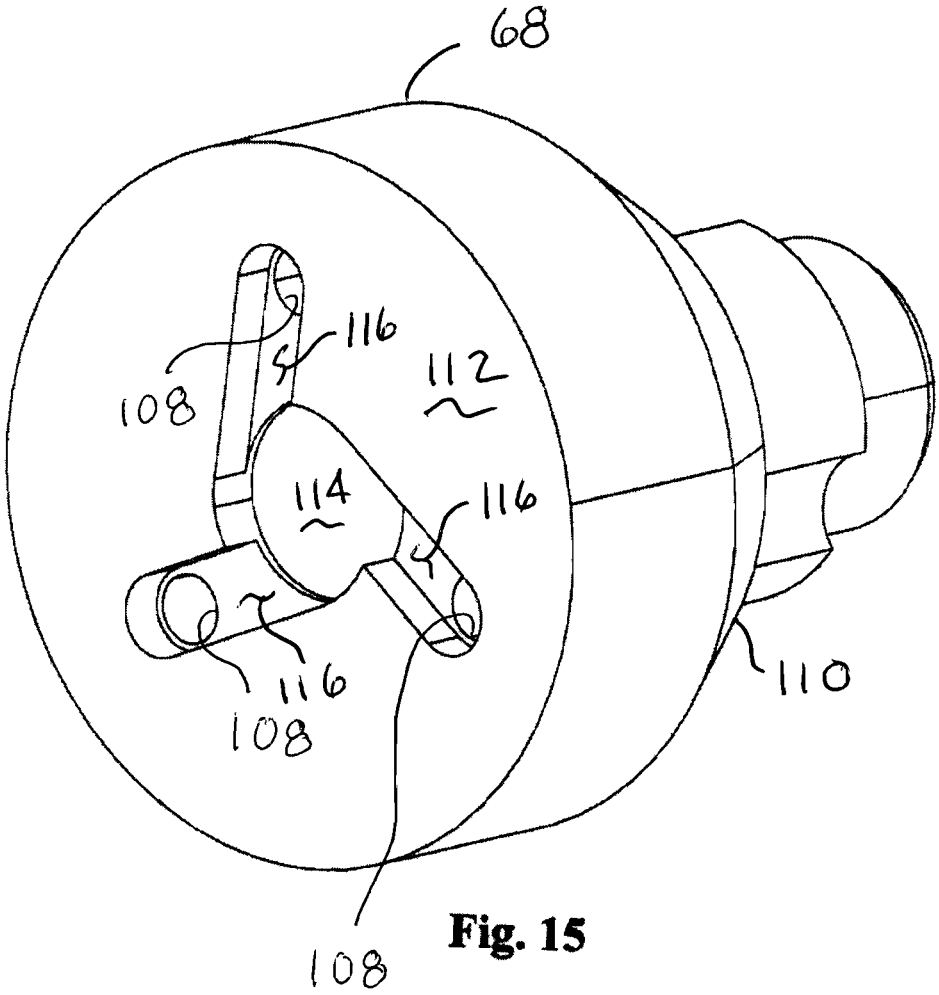
FIG. 15 is a perspective view of the swirl valve from FIG. 6.
Figure 16:
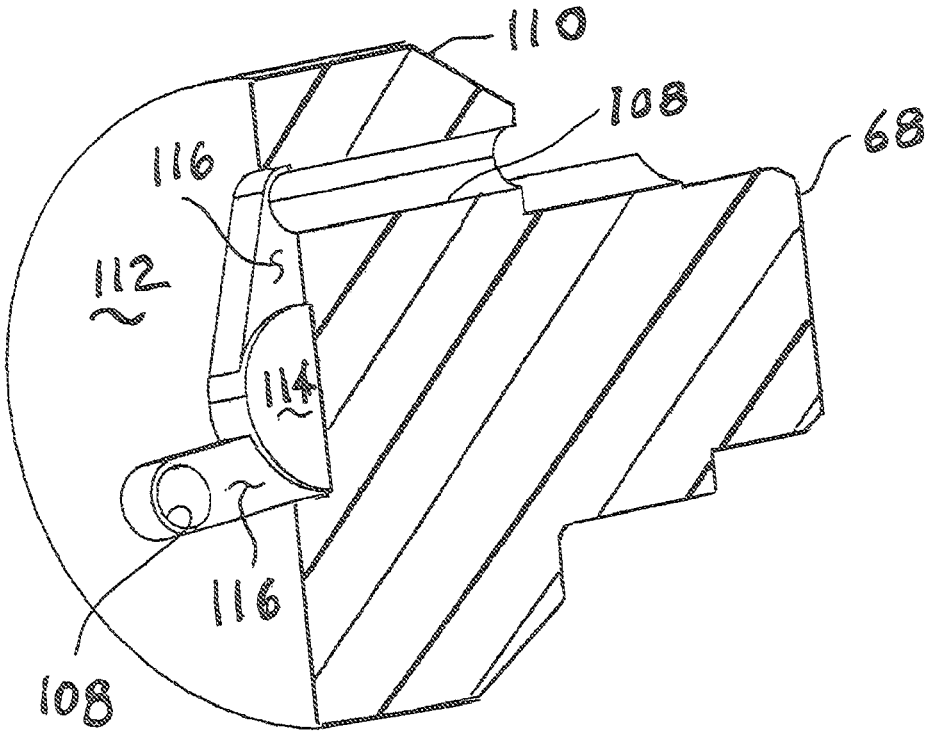
FIG. 16 is a perspective view with a section taken along line XVI-XVI of FIG. 17 of the swirl valve of FIG. 15.
Figure 17:
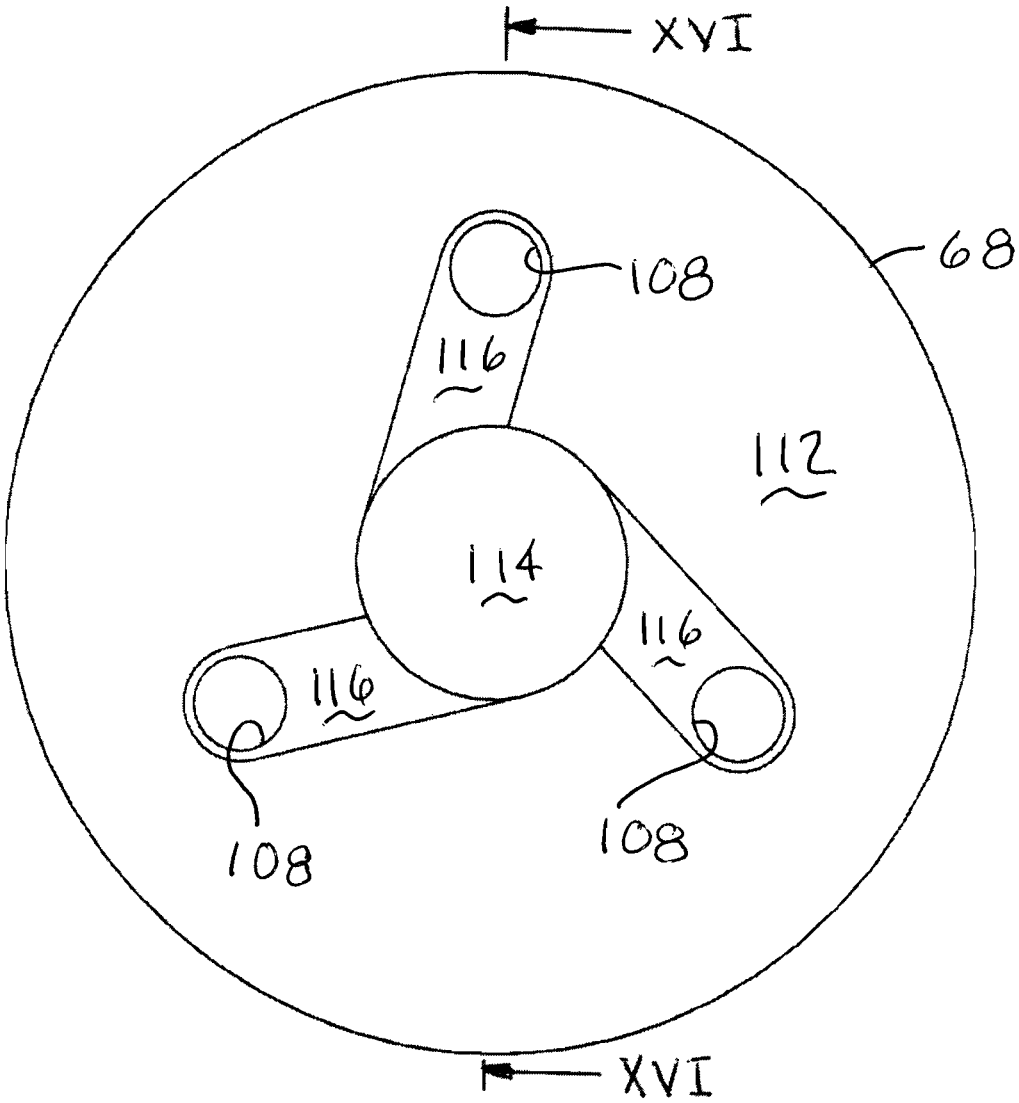
FIG. 17 is a front view of the swirl valve of FIG. 15.
Figure 18:
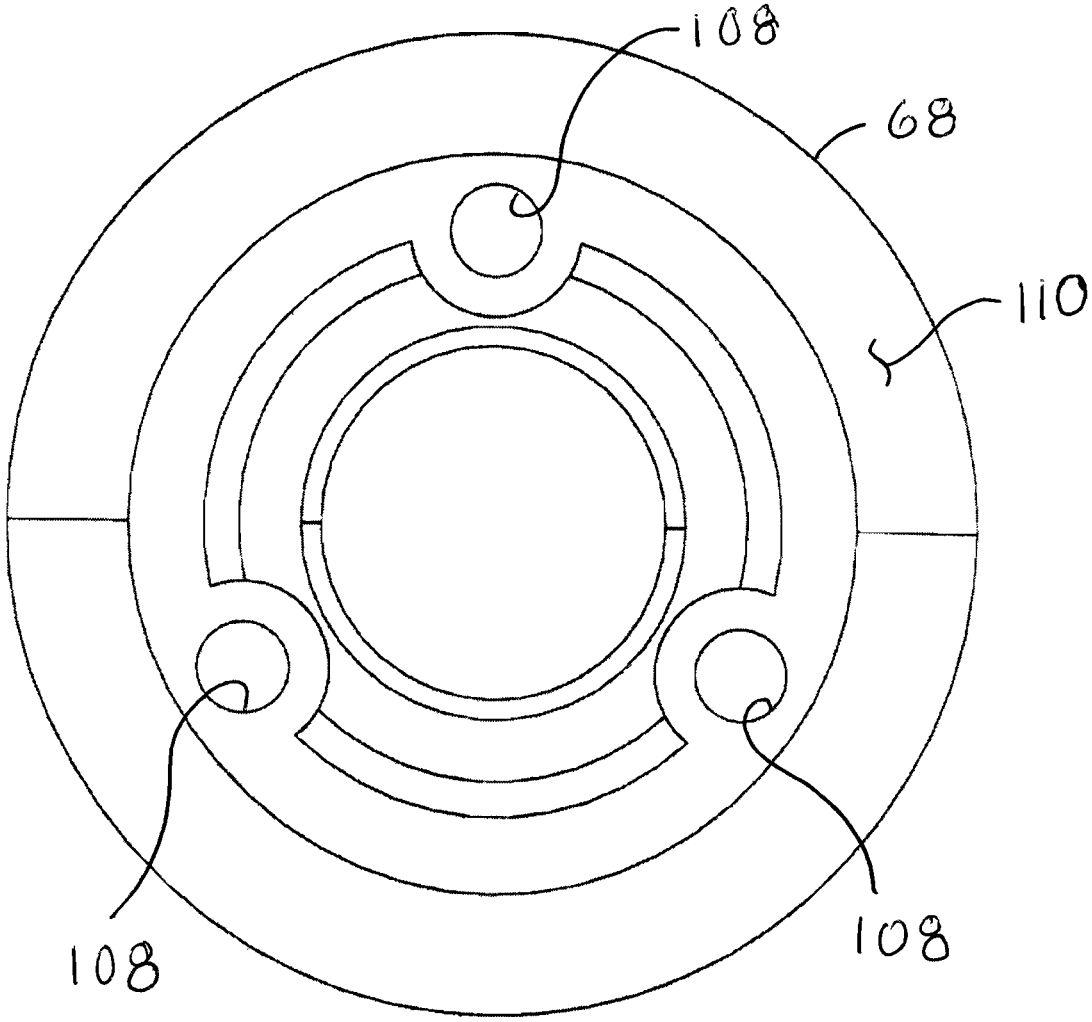
FIG. 18 is a rear view of the swirl valve of FIG. 15.
Figure 19:
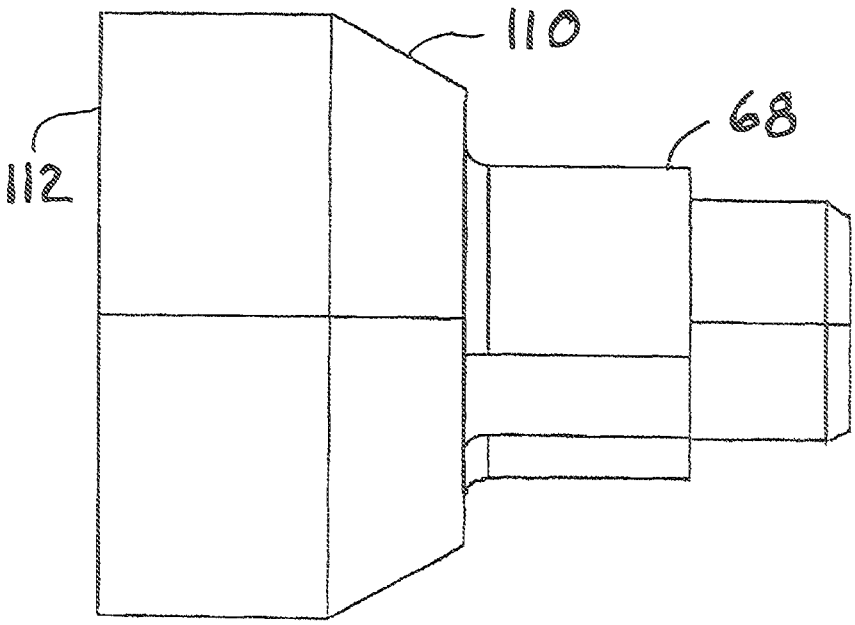
FIG. 19 is side view of the swirl valve of FIG. 15.
Figure 20:
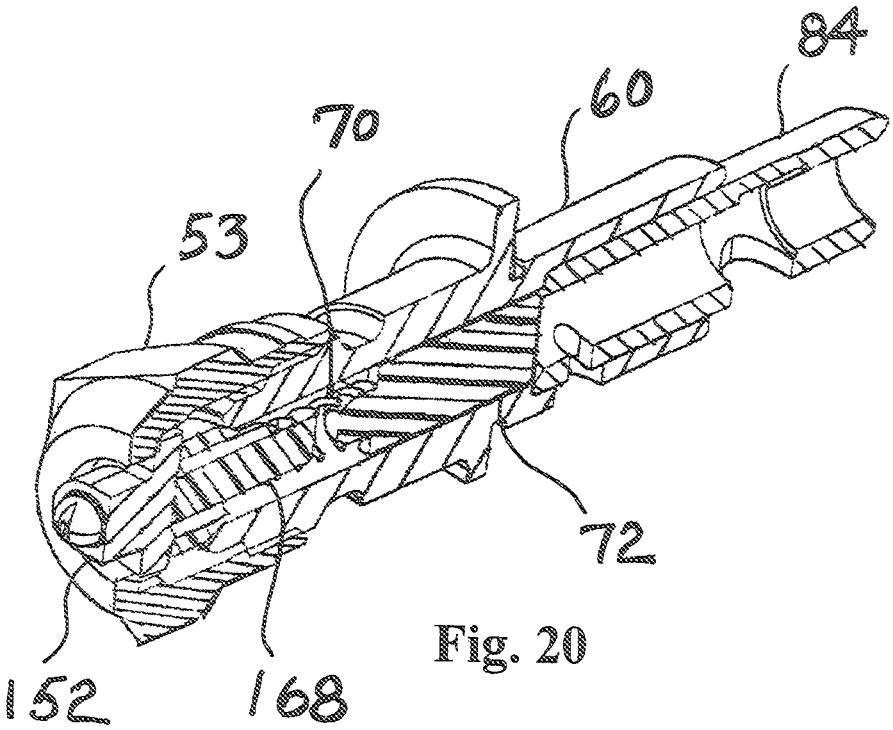
FIG. 20 is a perspective view in section of a spray tip assembly similar to that of FIG. 5, except without the swirl chamber plate and with an alternative swirl valve.
Figure 21:
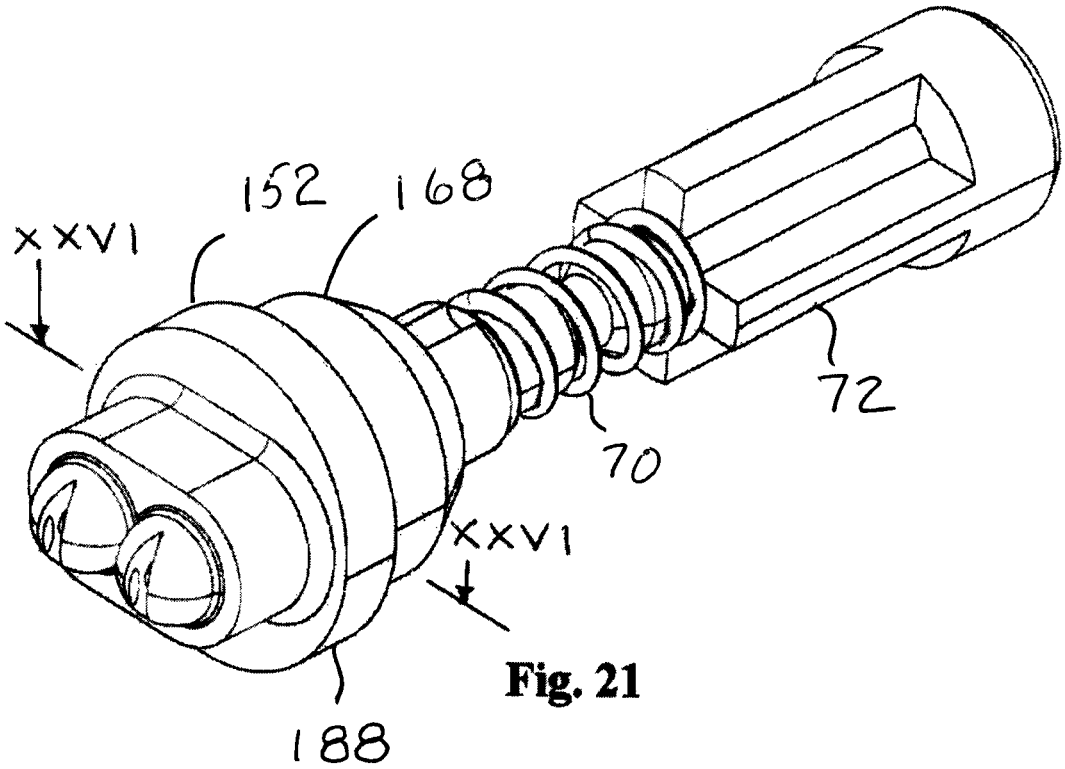
FIG. 21 is an enlarged perspective view of the dual orifice spray tip, swirl valve, spring and check valve from FIG. 20.

Referring now to FIGS. 13 and 14, various views of the swirl chamber adapter 54 may be seen. FIG. 14 also includes a section view of the swirl valve 68 to better illustrate the swirl chamber 100 formed by the adapter 54 and valve 68. Adapter 54 may be in the form of a stepped disk 102 with a central bore 104 therethrough. Disk 102 has a generally planar inlet surface 106 facing upstream towards the swirl valve 68.

Figure 9:
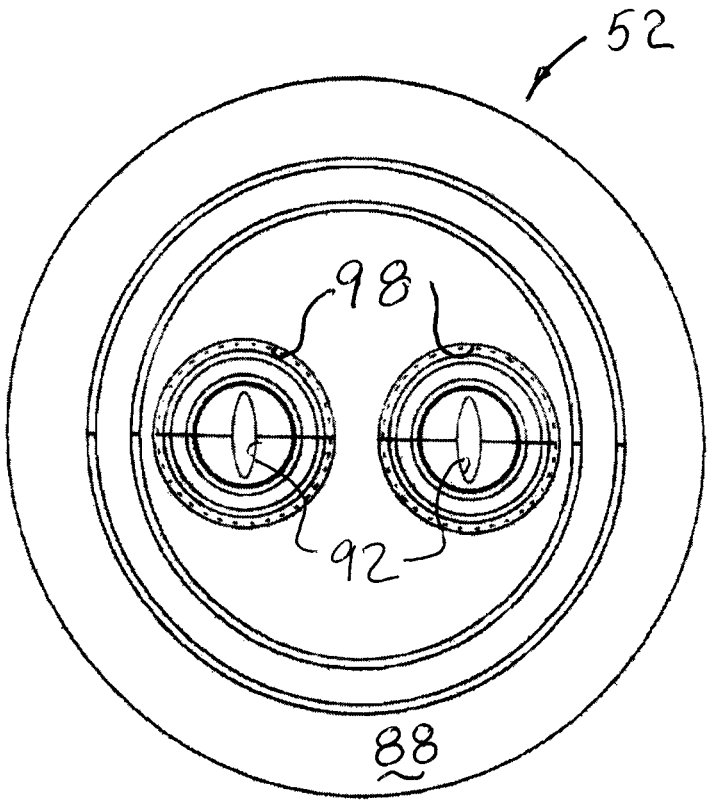
FIG. 9 is a rear view of the spray tip of FIG. 7.
Figure 10:
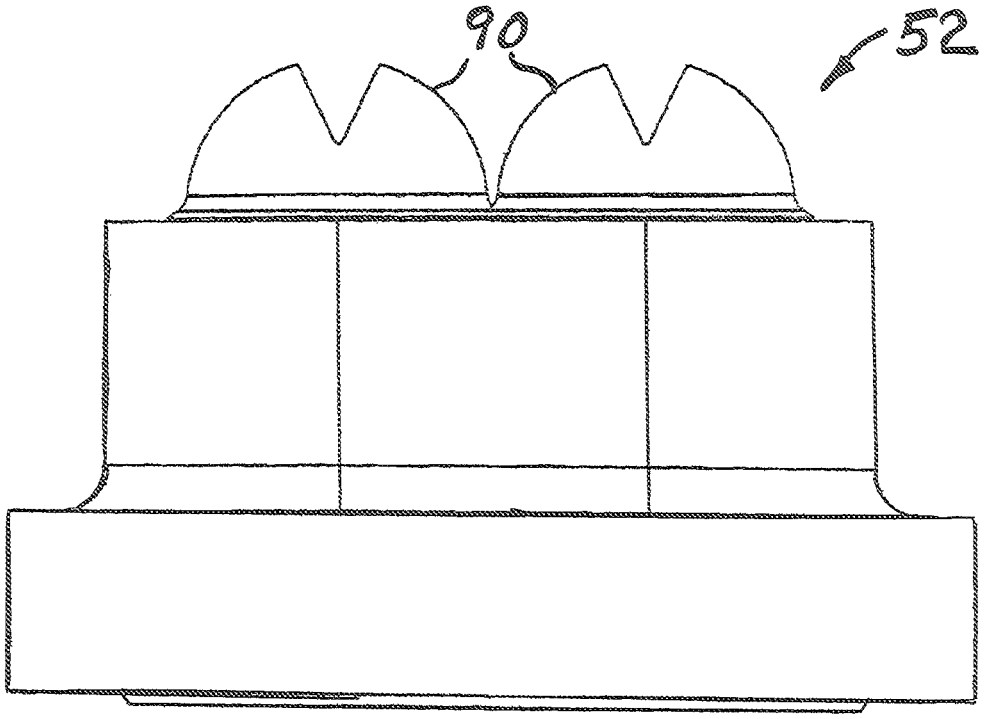
FIG. 10 is a side view of the spray tip of FIG. 7.
Figure 11:
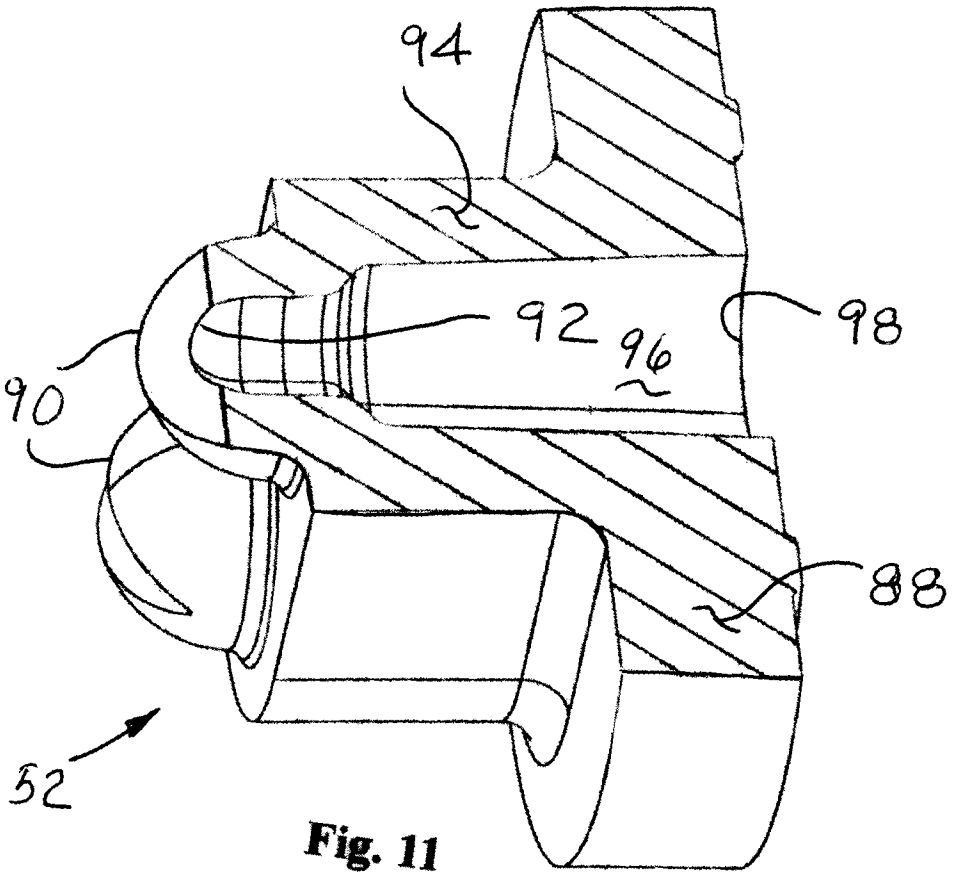
FIG. 11 is a perspective view with a first section of the spray tip of FIG. 7, taken along line XI-XI of FIG. 8.
Figure 12:
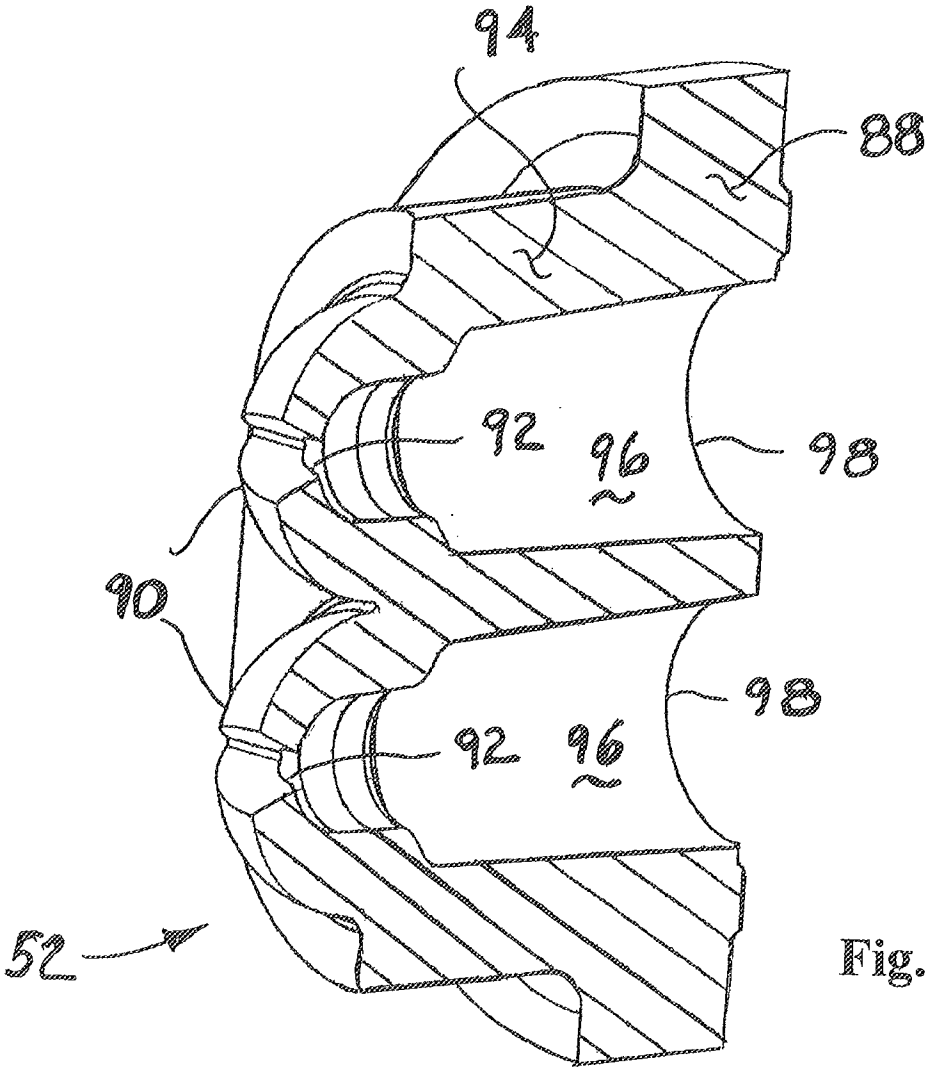
FIG. 12 is another perspective view with a second section of the spray tip of FIG. 7, taken along line XII-XII of FIG. 8.

Referring now also to FIGS. 9, 10 and 11, details of the swirl valve 86 may be seen in more detail. Swirl valve 68, in this embodiment as in the prior art, has a plurality of passageways 108 therethrough. Swirl valve 68 also has a cone shaped surface 110 and a generally planar outlet surface 112. A recess 114 in surface 112 forms part of a swirl chamber (shown in FIG. 14), and is in fluid communication with passageways 108 via conduits 116 connecting passageways 108 with recess 114. The planar surface 106 of the adapter 54 in combination with the planar surface 112 forces fluid (such as paint) to flow from the passageways 108 through conduits 116 to recess 114. Because conduits 116 are generally tangential to recess 114, the fluid entering recess 114 will be swirled. The fluid will then pass through bore 104 and be delivered to the inlet apertures 98 of the dual orifice spray tip 52 with sufficient rotational momentum to provide satisfactory atomization.

Figure 22:
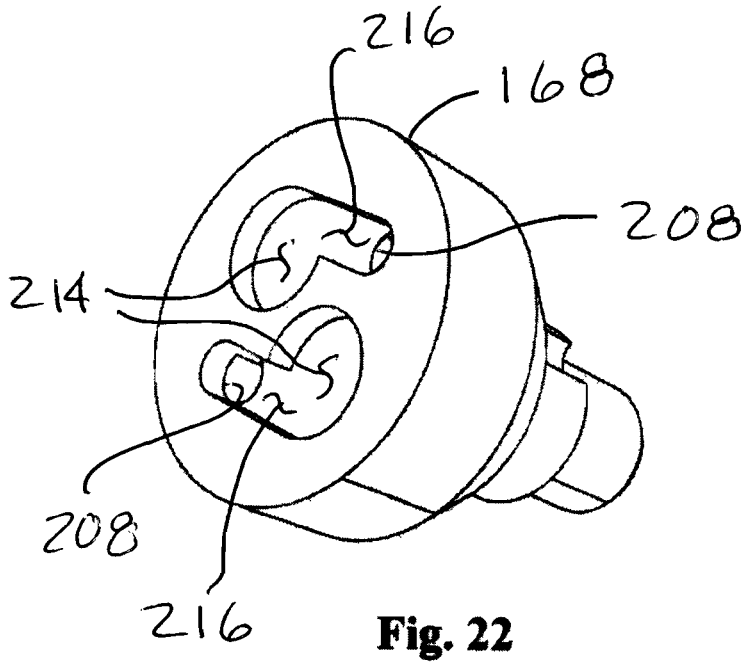
FIG. 22 is a perspective view from the front and below of the alternative swirl valve from FIG. 20 useful in the practice of the present invention.
Figure 23:
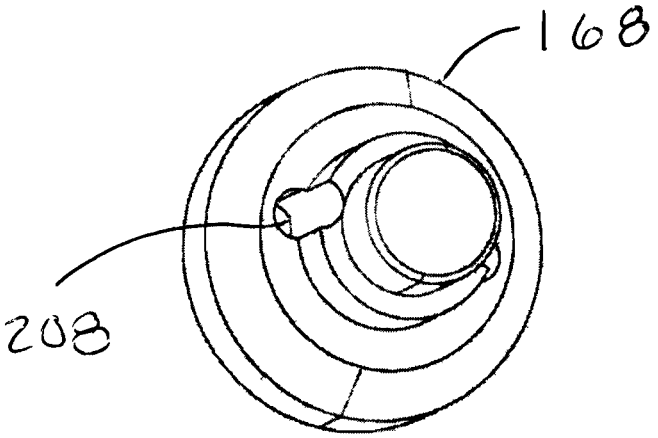
FIG. 23 is a perspective view from the rear and below of the swirl valve of FIG. 22.
Figure 24:
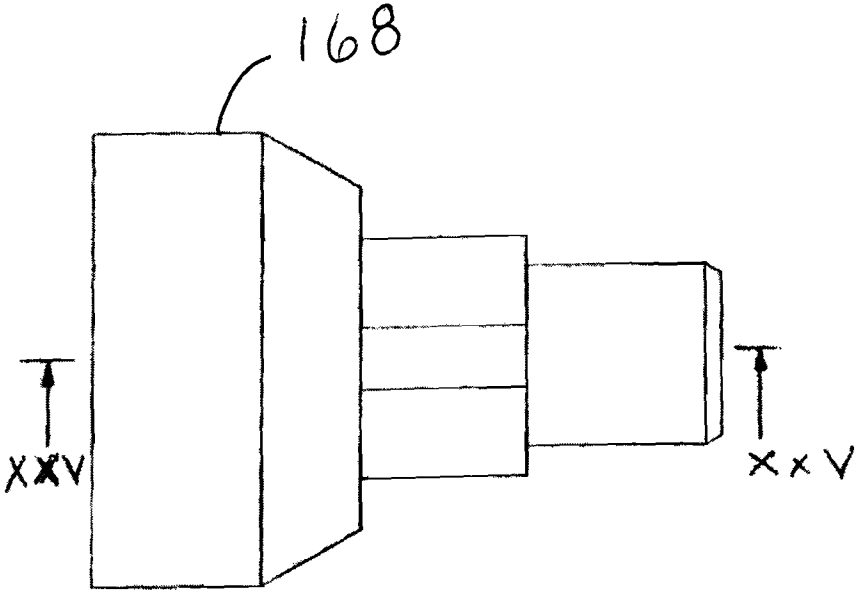
FIG. 24 is a side view of the swirl valve of FIG. 22.
Figure 25:
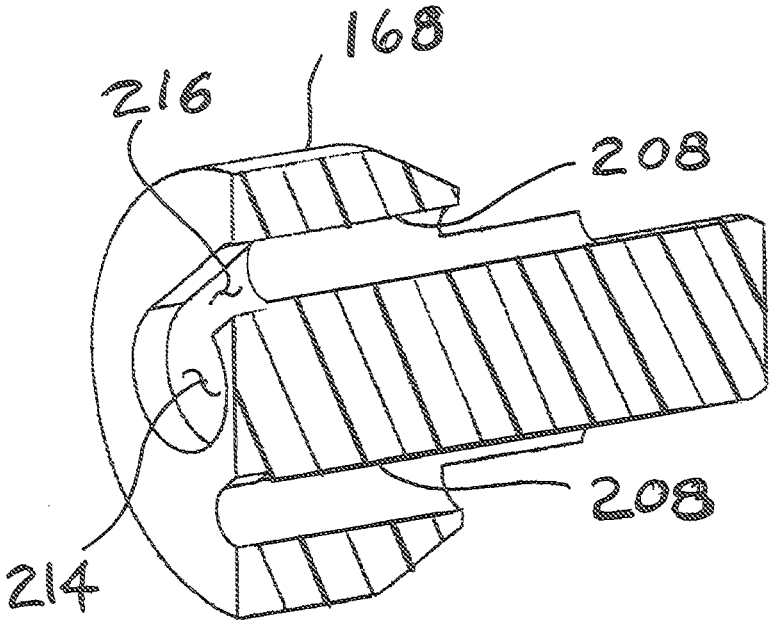
FIG. 25 is a perspective view in section of the swirl valve of FIG. 22 taken along line XXV-XXV of FIG. 24.
Figure 26:
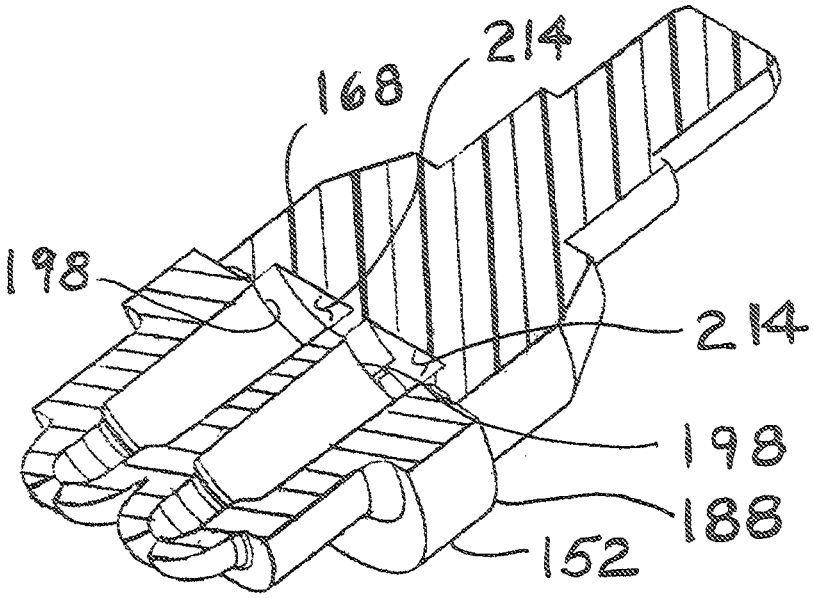
FIG. 26 is a perspective view of the spray tip and swirl valve shown in section along line XXVI-XXVI of FIG. 21.

An alternative embodiment is shown in FIGS. 20-26. In this embodiment, the spray tip 152 may be the same as spray tip 52 in the previous embodiment, with the exception that a key or keyway (not shown) may be provided on the base region 188 to align the spray tip inlet apertures 198 with a pair of recesses 214 in an alternative swirl valve 168. It is to be understood that swirl valve 168 will have the mating keyway or key (also not shown) to maintain this alignment between spray tip 152 and swirl valve 168. The alignment of recesses 214 with inlet apertures 198 eliminates the need for a swirl chamber adapter in this embodiment. Reference to FIGS. 22, 25 and 26 reveals that swirl valve 168 has a pair of recesses 214 corresponding to recess 114, except aligned with the inlet apertures 198, respectively of spray tip 152. Each recess is in fluid communication with at least one passageway 208 via a tangentially oriented conduit 216 in this embodiment.

Figure 27:
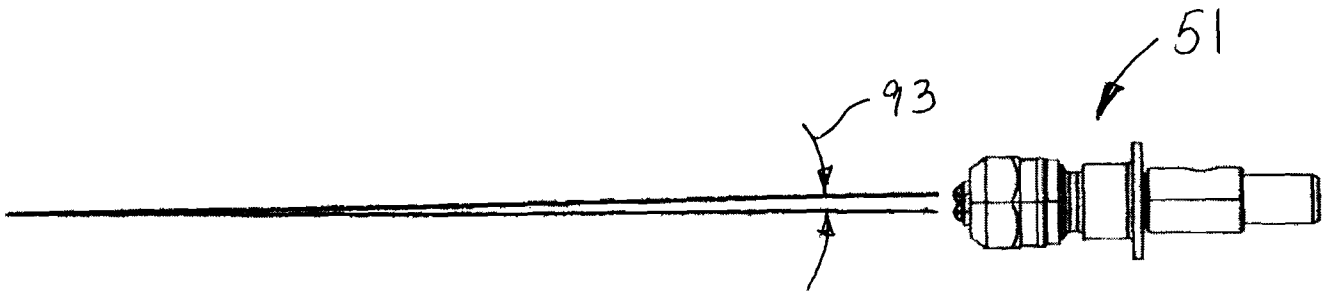
FIG. 27 is a plan view of a spray tip assembly of the present invention to illustrate convergence of a pair of centerlines of the spray patterns of the dual orifices of the spray tip in the practice of the present invention.

It is to be understood that the diagram of FIG. 27 is applicable to either embodiment described above. It has been found that spacing the apertures apart by about 0.025 inches with the convergence angle of about 3 degrees results in satisfactory operation, but another spacing and/or angle may be utilized in the practice of the present invention. Furthermore, it is within the scope of the present invention to vary the ratio between the major and minor axes of the ellipse (or equivalent ellipse) of the apertures and the resulting spray pattern.

In connection with the above described embodiments, the present invention may thus be seen to be a hand-held paint spray gun apparatus having a reciprocating piston in the gun for pressurizing paint and a swirl valve for imparting swirling motion in the paint to be sprayed and a dual orifice spray tip mounted on the gun, wherein the spray tip has a pair of apertures, each emitting a generally fan shaped spray pattern along a centerline, with the centerlines of the spray patterns converging towards each other as the spray patterns exit from the apertures.

In one aspect, the present invention has a convergence angle of about 3 degrees.

In another aspect, the present invention may include a swirl chamber adapter positioned between an outlet of a swirl valve and an inlet of the dual orifice spray tip wherein the adapter has a generally planar face opposing the swirl valve in the gun and forming a swirl chamber upstream of the spray tip and further wherein the adapter has a centrally located bore extending through the adapter to deliver the paint from the to the spray tip.

In a still further aspect, a swirl valve may have a pair of outlet recesses aligned with inlet apertures in the dual orifice spray tip, providing a pair of swirl chambers without the need for a swirl chamber adapter between the swirl valve and the spray tip.

Figure 28:
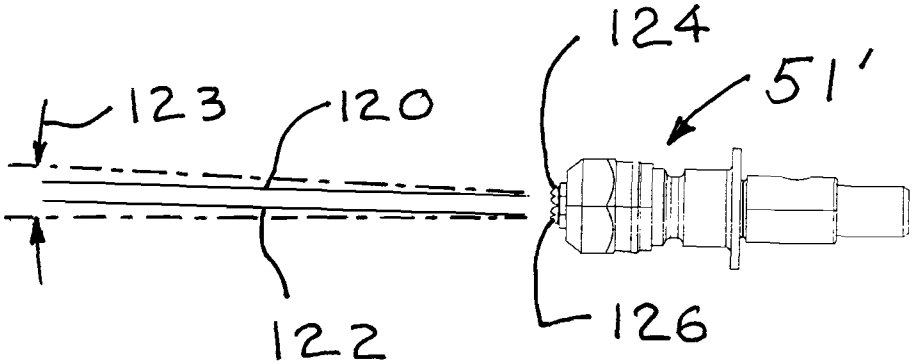
FIG. 28 is a plan view similar to that of FIG. 27, except showing an alternative aspect of the present invention in which the pair of centerlines of the spray patterns of the dual orifices of the spray tip are parallel in an alternative embodiment of the present invention.

Referring now to an alternative embodiment, FIG. 28 illustrates that the present invention may also be practiced using overlapping spray patterns having parallel centerlines 120, 122. Centerlines 120 and 122 are to be understood to be representations of the respective centers of fan shaped spray patterns emitted from tips 124 and 126, respectively when the tips are mounted in parallel in a spray tip subassembly or cartridge 51'. As shown in FIG. 28, cartridge 51' may be the same as subassembly 51 shown in section in FIG. 5, except for the orientation of the centerlines. Alternatively, the subassembly 51' may be of a different manufacture than that of subassembly 51, as described infra. Also, as shown in FIG. 28, the centerlines 120 and 122 may diverge by up to an angle 123 of about 5 degrees, while still remaining within the scope of the present invention.

Figure 29:
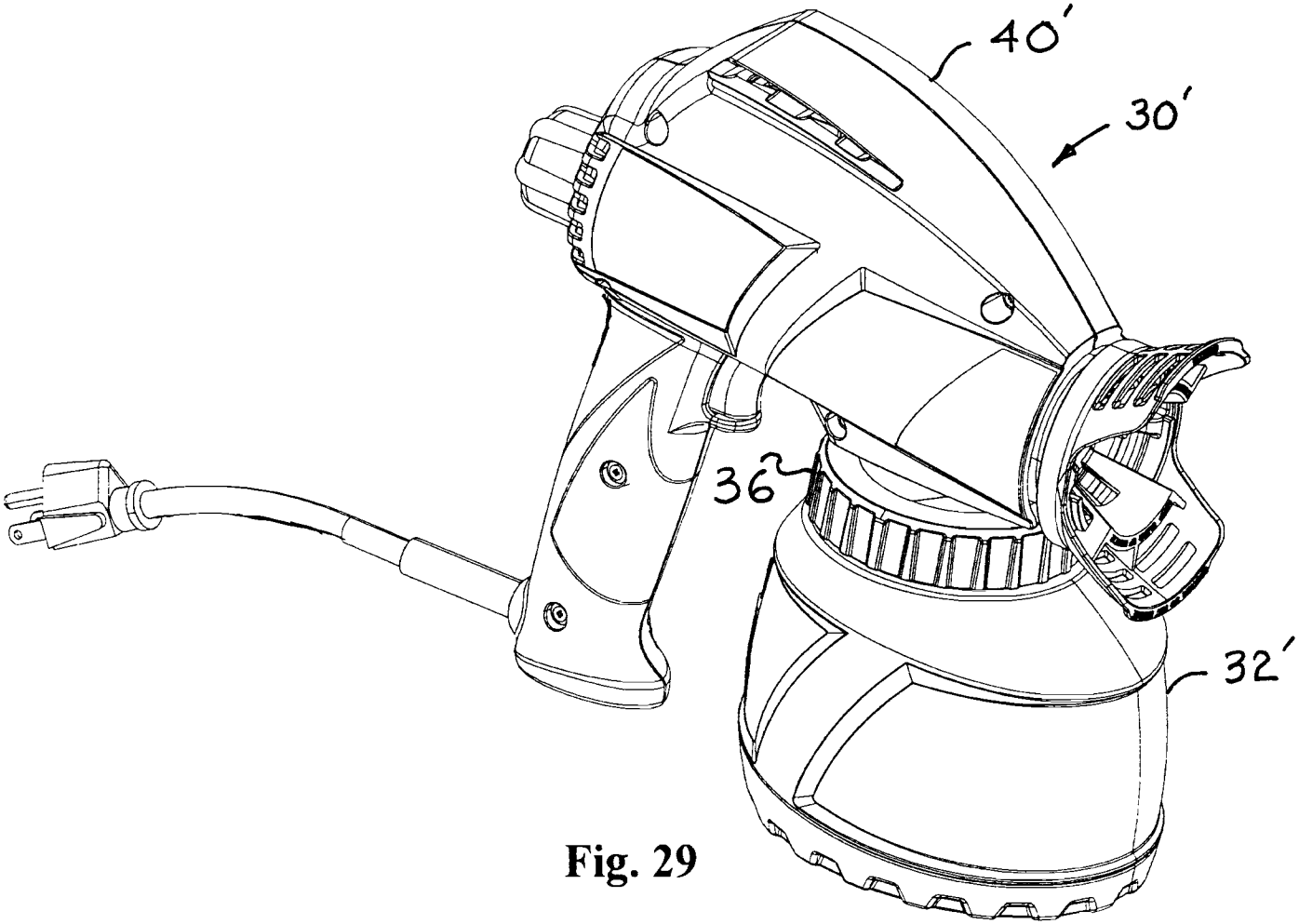
FIG. 29 is a perspective view of another example of a hand-held paint spray gun useful in the practice of the present invention.

FIG. 29 is a perspective view of an alternative embodiment of a cup gun 30' useful in the practice of the present invention, including (but not limited to) using the parallel centerline approach of FIG. 28. As with gun 30, the gun 30' is often referred to as a "cup gun." The cup gun 30' is characterized by having a hand-held paint pump including a piston 82' and cylinder 60' within a gun housing 40' of the hand-held assembly. The gun 30' may also have a paint reservoir 32' mounted directly on the gun 30'.

Figure 30:
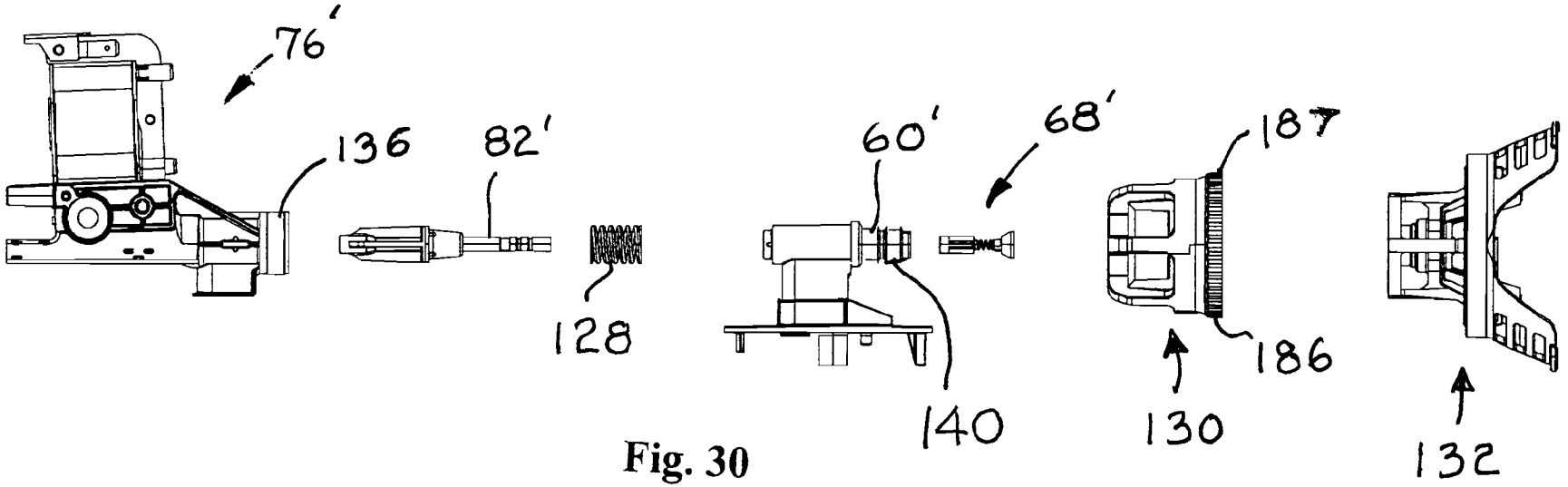
FIG. 30 is an exploded side elevation view of some of the parts of the paint spray gun of FIG. 29.
Figure 31:
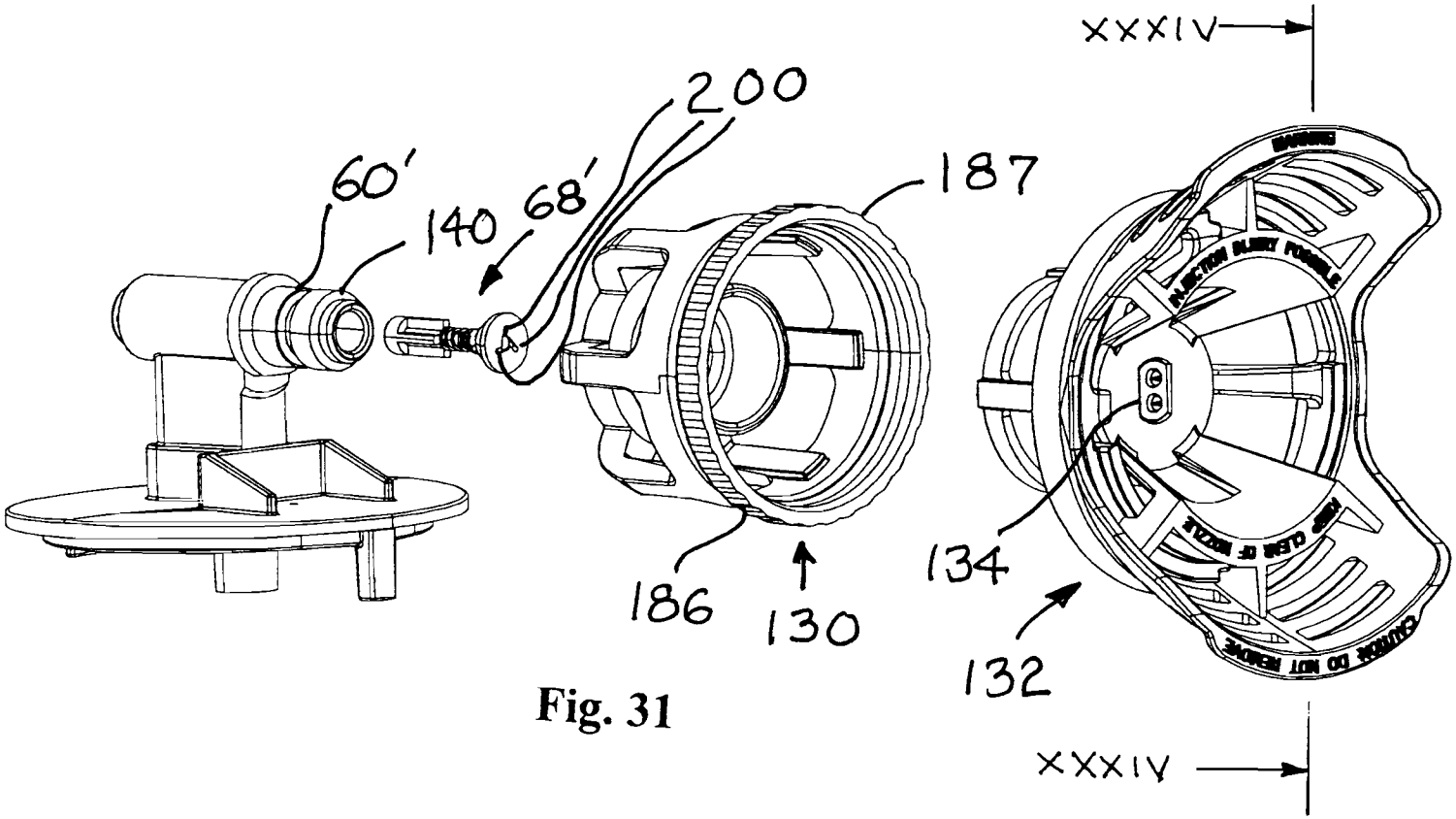
FIG. 31 is an enlarged perspective view from the side and front of a pump cylinder, swirl valve, locking nut, and spray tip assembly of FIG. 30.
Figure 35:
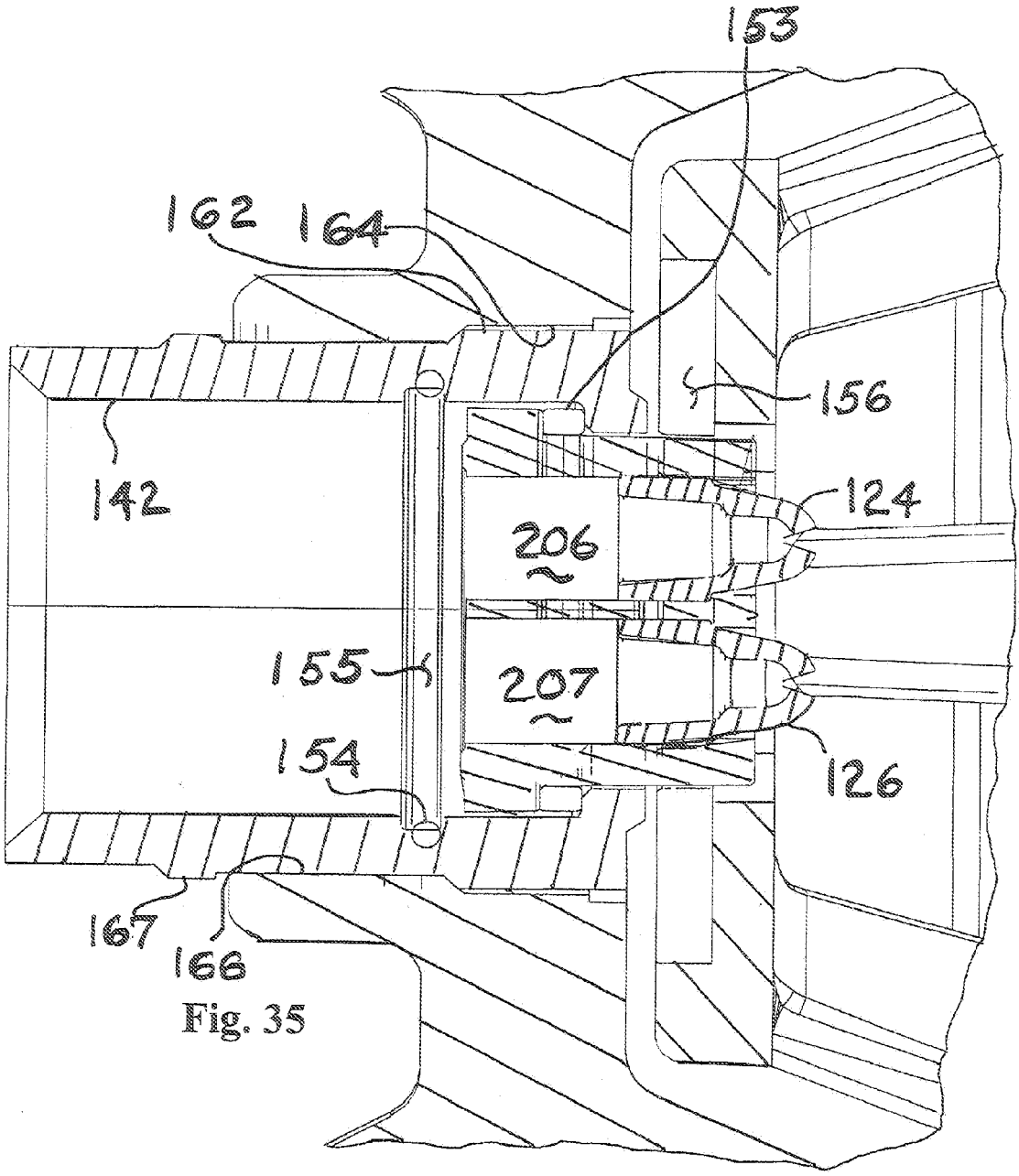
FIG. 35 is an enlarged side section view of a portion of the spray tip assembly shown in FIG. 34.

Referring now to FIGS. 30 and 31, certain internal parts of gun 30' may be seen. An electric motor 76' reciprocatingly drives the piston 82' against a return spring 128 with the forward end of piston 82' reciprocating within the cylinder 60'. A swirl valve assembly 68' is located at the front of cylinder 60. A locking nut 130 secures the cylinder 60' to the motor 76' and a spray tip assembly 132 includes a pair of spray tip orifices and secures the swirl valve assembly 68' between the cylinder 60' and a spray tip subassembly 134. It is to be understood that a frame of motor 76' preferably has external threads located at a forward end 136 thereof, and nut 130 preferably has mating internal threads 138 (visible in FIG. 38). It is also to be understood that cylinder 60' preferably has external threads located at a forward end 140 thereof, and the spray tip subassembly 134 preferably has mating internal threads located at a rearward portion 142 (indicated in FIG. 35). Swirl valve assembly 68' is preferably similar to swirl valve 68 together with spring 70 and check valve 72, except that assembly 68' may have different dimensions than swirl valve 68.

Figure 32:
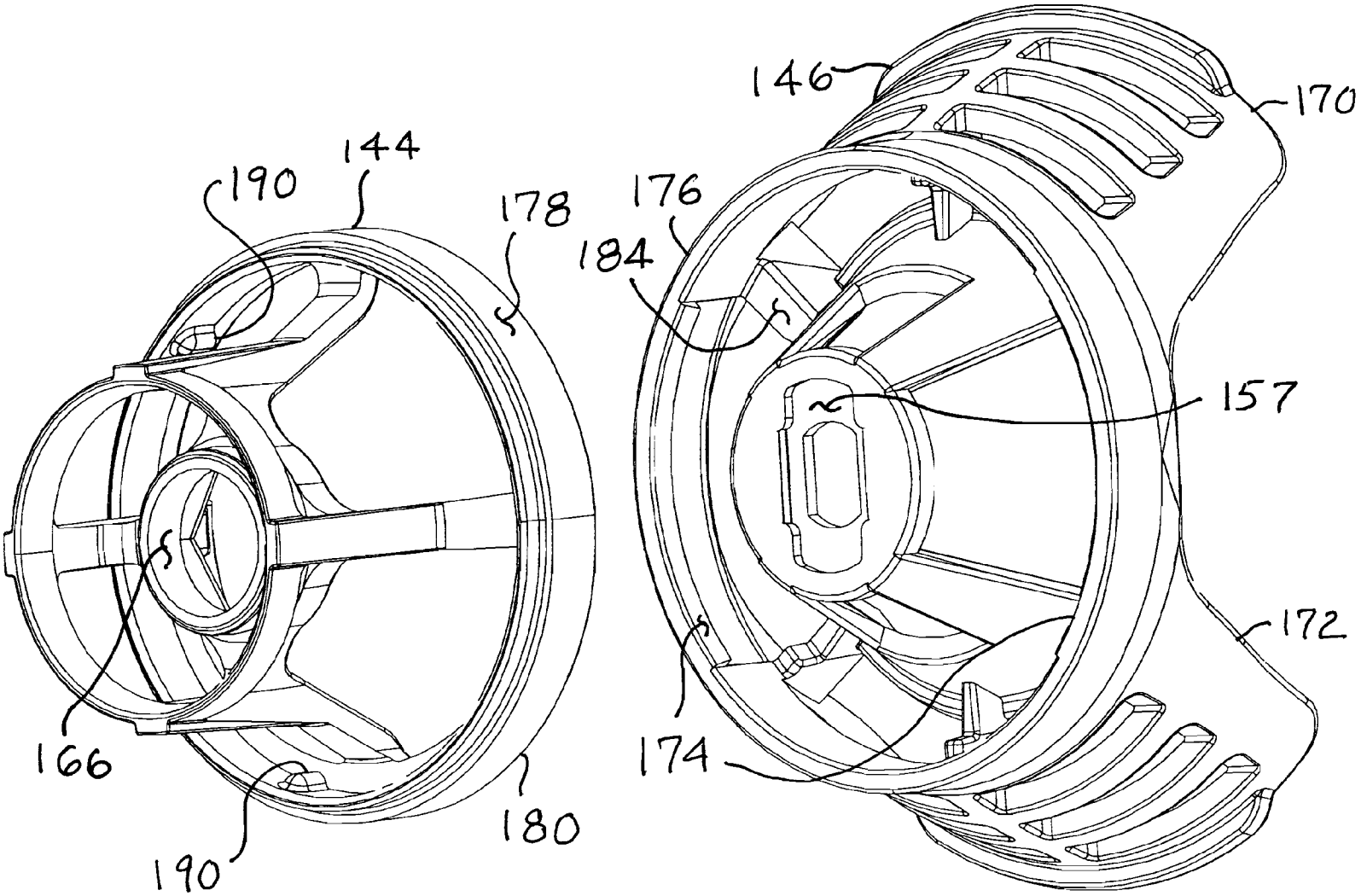
FIG. 32 is an enlarged perspective view from the side and rear of a spray tip holder and tip guard from the spray tip assembly of FIG. 30.
Figure 33:
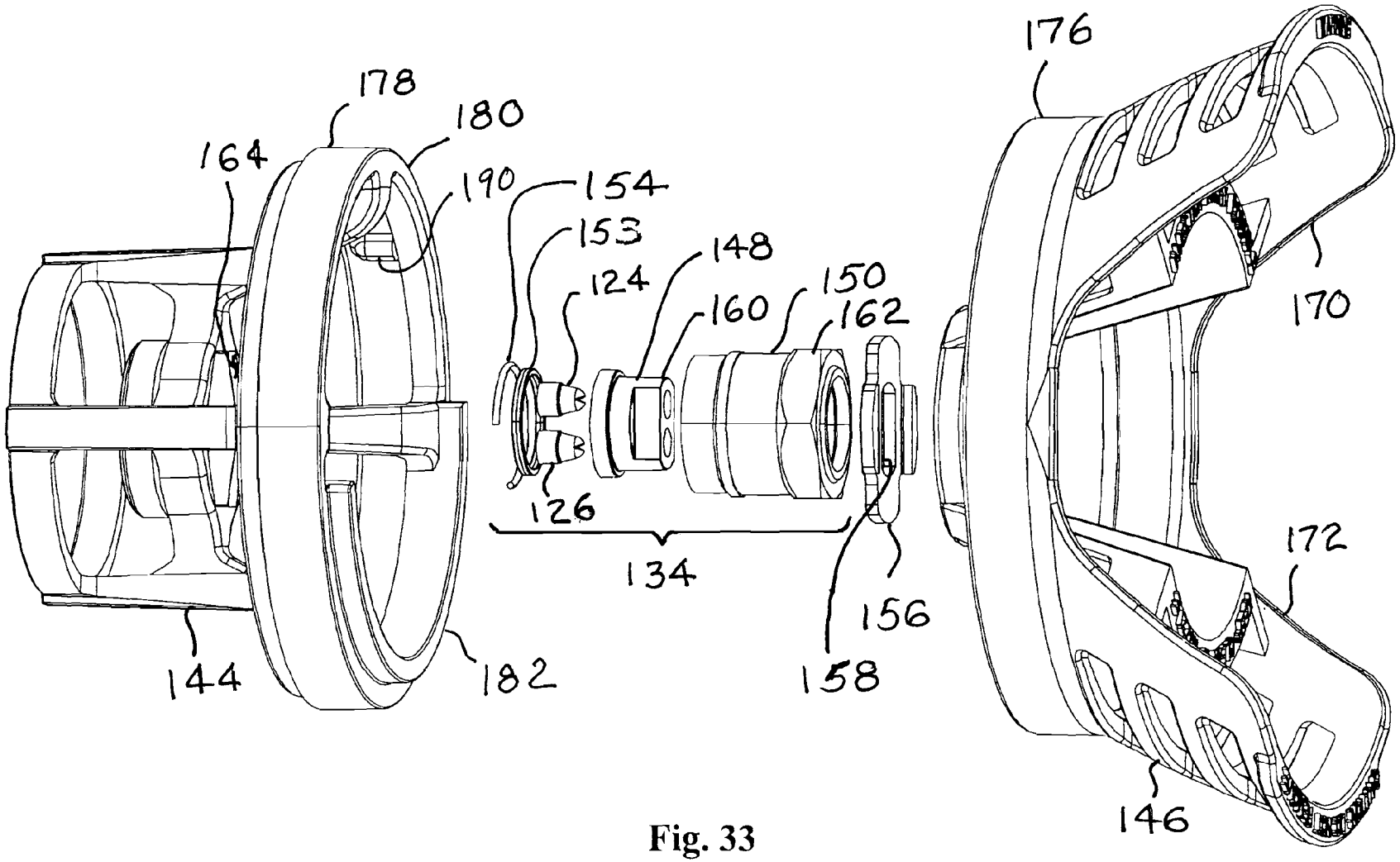
FIG. 33 is an exploded perspective view from the side of the spray tip assembly of FIG. 30.
Figure 34:
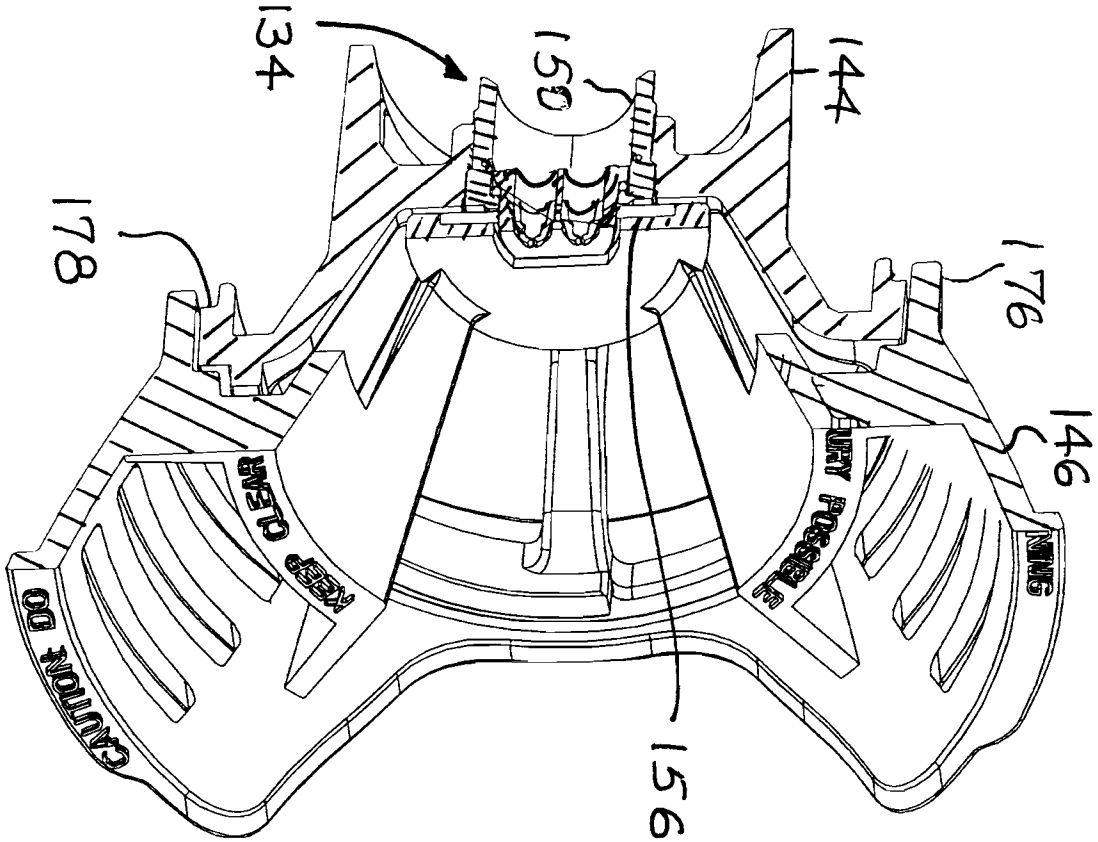
FIG. 34 is a section view from the side and front of the spray tip assembly of FIG. 30 taken along line XXXIV-XXXIV of FIG. 31.
Figure 42:
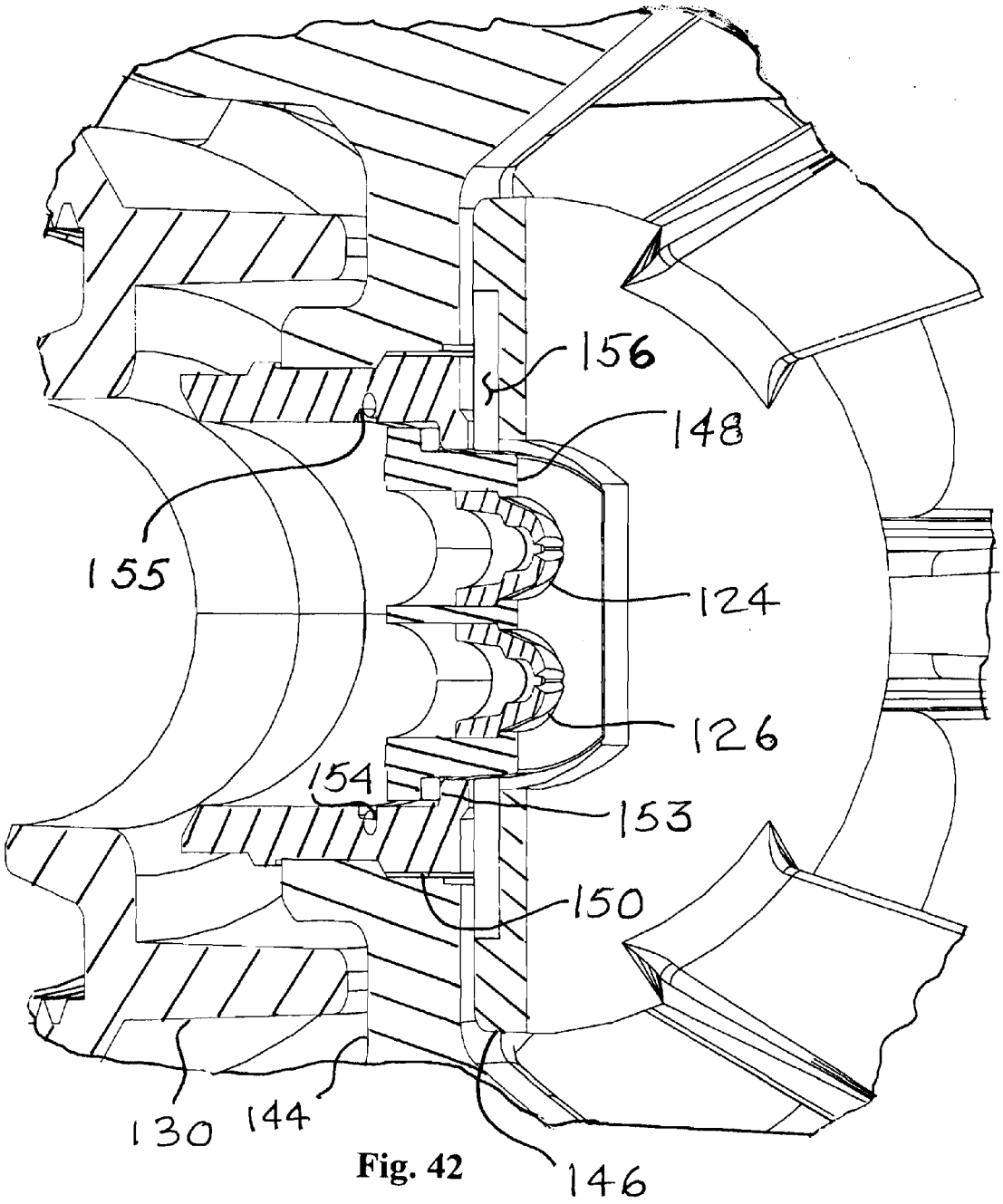
FIG. 42 is an enlarged detail section view of a portion of the parts shown in FIG. 41, except from the side and front.

Referring now to FIGS. 32, 33 and 34 various details of the spray tip assembly 132 may be seen. FIG. 32 shows a spray tip frame 144 and a spray tip guard 146. FIG. 33 shows the frame 144 and guard 146 along with an exploded view of the spray tip subassembly 134. Spray tip subassembly 134, in this embodiment, preferably has the pair of spray tip inserts 124, 126 pressed into a tip holder 148. Tip holder 148 is loosely received in a nozzle head 150 such that tip holder 148 can rotate within the nozzle head 150. A washer or ring 153, is preferably formed of polyacetal polymer available from DuPont under the trademark DELRIN. A snap ring or retaining ring 154 prevents tip holder 148 from axially escaping from the nozzle head 150. As shown in the drawings (particularly FIGS. 35, 37, and 42), it is to be understood that ring 154 is shown in its relaxed state and superimposed on an internal groove 155 formed in the nozzle head 150. In practice ring 154 will be slightly radially compressed and rest within groove 155. A key 156, preferably formed of metal such as steel, is preferably molded into a recess 157 in the spray tip guard 146. Key 156 has a non-circular aperture 158 sized to be received over and mate with a corresponding non-circular projection 160 on tip holder 148. Tip holder 148 may be formed as a zinc die cast part. Nozzle head 150 is preferably formed of metal, such as steel. Frame 144 and guard 146 are preferably formed of a suitable polymer. Once assembled together (as shown in FIG. 34) the frame 144 and guard 146 are retained together, but are free to rotate within a range of approximately (and preferably slightly greater than) 180 degrees rotation. This allows the spray tip subassembly 134 to be rotated to align the fan shaped spray patterns within a range to position the fan shaped spray patterns either vertically or horizontally, as desired, by a user.

The frame 144 and guard 146 individually and collectively provide several functions. Frame 144 carries the spray tip subassembly and provides a positive rotational drive connection between frame 144 and the spray tip subassembly 134 by a nesting relationship between a hexagonal end portion 162 on the nozzle head 150 and a mating hexagonal recess 164 in frame 144. Nozzle head 150 is retained in frame 144 against longitudinal or axial movement by capture of a reduced diameter portion 166 of frame 144 between the hexagonal end portion 162 and a raised lip 167 on nozzle head 150. Guard 146 carries frame 144 and spray tip subassembly 134. Guard 146 has wings 170, 172 extending forward in front of spray tip subassembly 134. Wings 170 and 172 may be used as handles to grasp and rotate guard 146.

When frame 144 is received and retained in guard 146, guard 146 may be rotated to one end of the range of rotational freedom at which point the frame may be urged to thread or unthread with respect to the forward end 140 of cylinder 60'. To accomplish this, a user will typically grasp the guard 146 and rotate it to the end of travel in the rotational direction desired, after which continued rotation in the same direction will rotate the frame 144 to engage or disengage it with respect to the cylinder 60'. It is to be understood that the swirl valve 68' is retained between the cylinder 60' and the spray tip subassembly 134 when the nozzle head 150 is threaded onto the forward end 140 of the cylinder 60'.

Once the frame 144 is fully threaded onto cylinder 60', guard 146 may be used to rotate the tip holder 148, to position the fan pattern to a horizontal or vertical orientation, as desired by a user. Key 156 (which is preferably molded into guard 146) will rotate with guard 146 through the range of rotational freedom between the guard 146 and frame 144, without rotating the frame, to position the tip holder 148 to a desired angular orientation.

Figure 43:
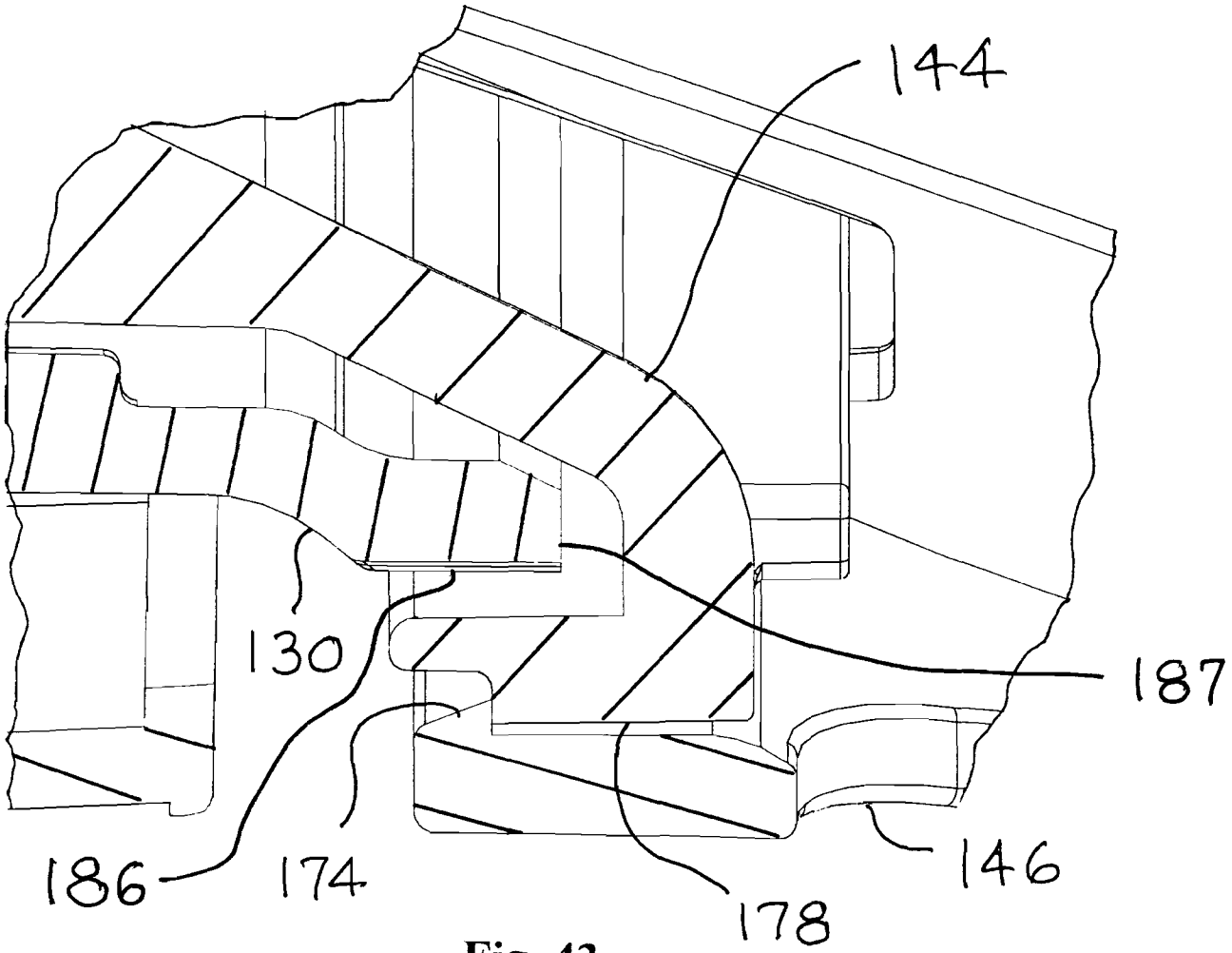
FIG. 43 is an enlarged fragmentary section view taken along line XLIII of FIG. 38.

A pair of lips 174 are positioned diametrically opposite each other on a rear portion 176 of guard 146 and extend as arcuate segments, positioned at right angles to the orientation of the wings 170, 172. Lips 174 are received over an enlarged diameter ring 178 on a front portion 180 of the frame 144, as shown in section in FIG. 43.

Referring now again to FIGS. 32 and 33, an arcuate segment 182 projects forward from the front portion 180 of frame 144. Segment 182 will contact an end stop member 184 internal of the rear portion 176 of the guard 147 when the frame 144 and guard 146 reach the end of the rotational range of travel between the frame 144 and guard 146.

To assembly the internal parts of the gun 30 (referring to FIG. 30) the spring 128 is received over the piston 82' and the piston 82' is then inserted into the back of cylinder 60'. The cylinder 60' (along with the piston 82' and spring 128 is inserted into the forward end 136 of the frame of motor 76'. The swirl valve 68' is then placed into the front end 140 of cylinder 60' and the locking nut 130 is threaded onto the forward end 136 of the motor frame.

Once the spray tip assembly 132 (made up of spray tip subassembly 134, frame 144 and guard 146) is assembled together (as shown in FIG. 31, for example), the spray tip assembly 132 may be threaded onto the forward or front end 140 of the cylinder 60' and drawn up to seal the swirl valve 68' against the cylinder 60' by rotating the guard through its range of circumferential motion with respect to the frame 144 and by continuing to rotate the guard to thread the nozzle head 150 onto the threaded forward end 140 of cylinder 60'.

Figure 38:
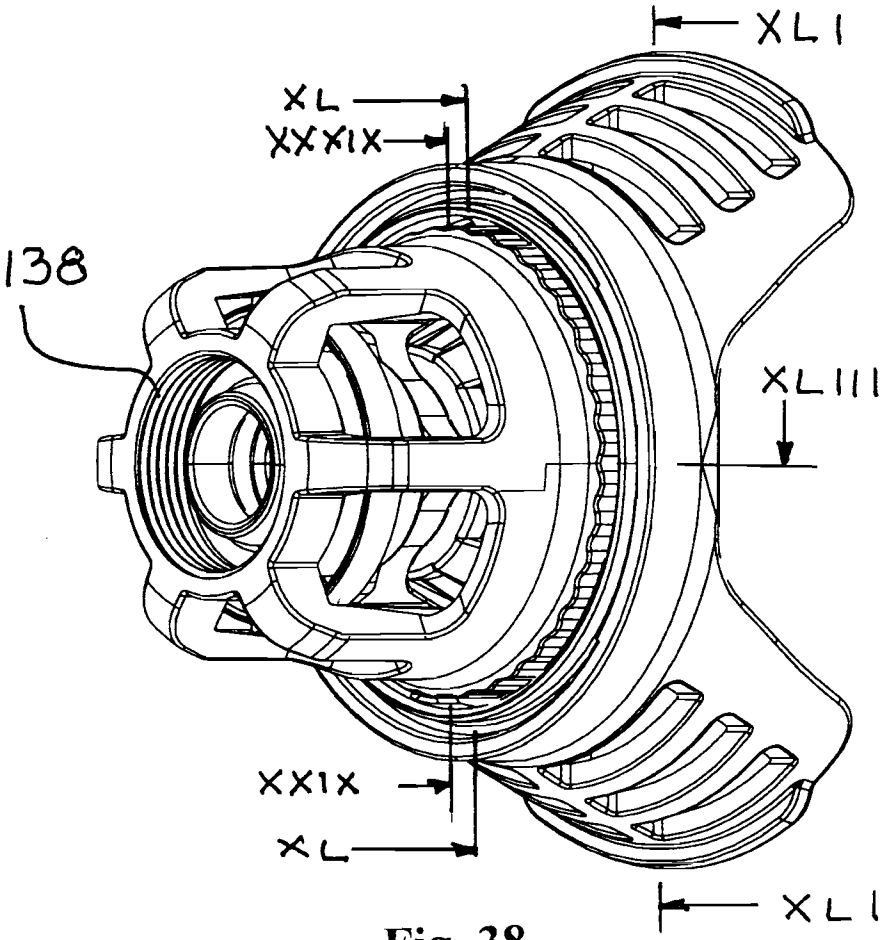
FIG. 38 is perspective view from the side and rear of the locking nut and spray tip assembly from FIG. 30, except assembled together to illustrate certain aspects of the present invention.
Figure 39:
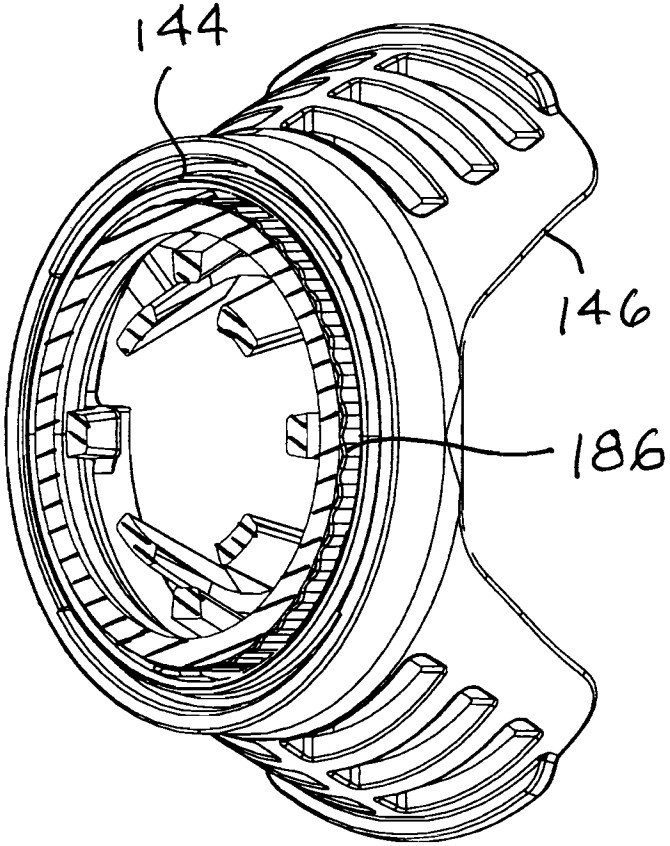
FIG. 39 is a first section view from the rear and side of the parts shown in FIG. 38, taken along line XXXIX-XXXIX of FIG. 38.
Figure 40:
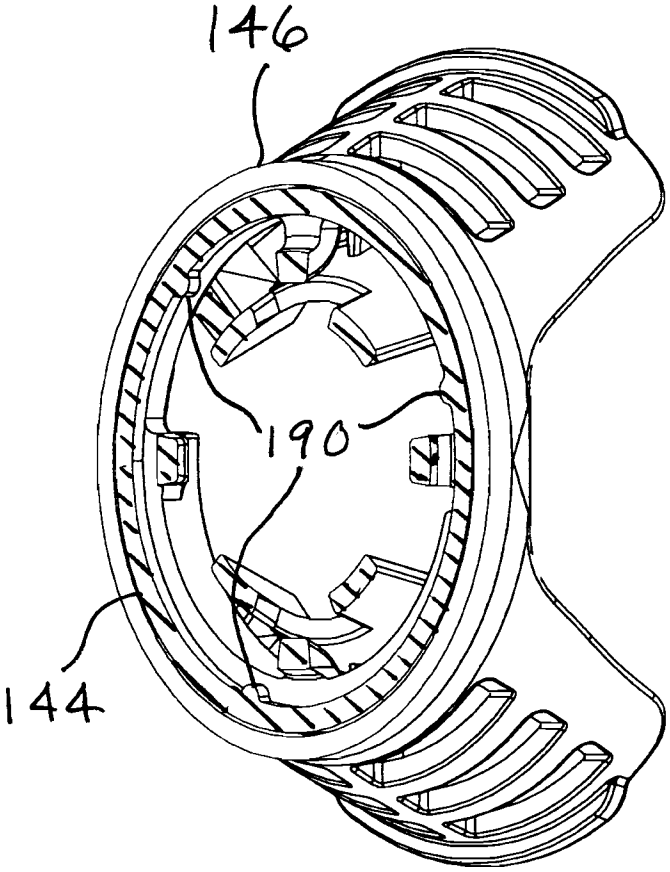
FIG. 40 is a second section view from the rear and side of the parts shown in FIG. 38, taken along line XL-XL of FIG. 38.
Figure 41:
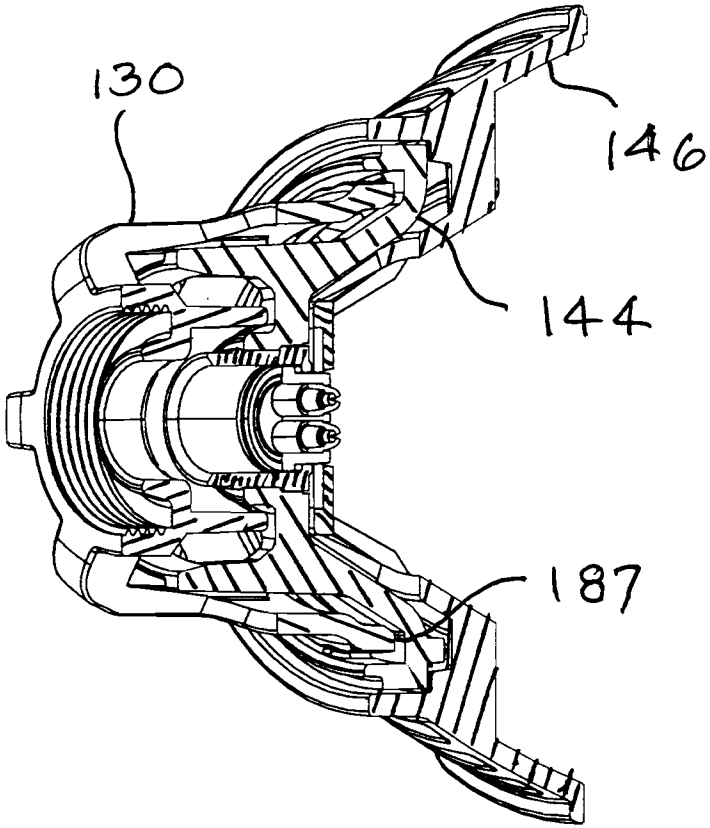
FIG. 41 is a third section view from the side and rear of the parts shown in FIG. 38, taken along line XLI-XLI of FIG. 38.
Figure 44:
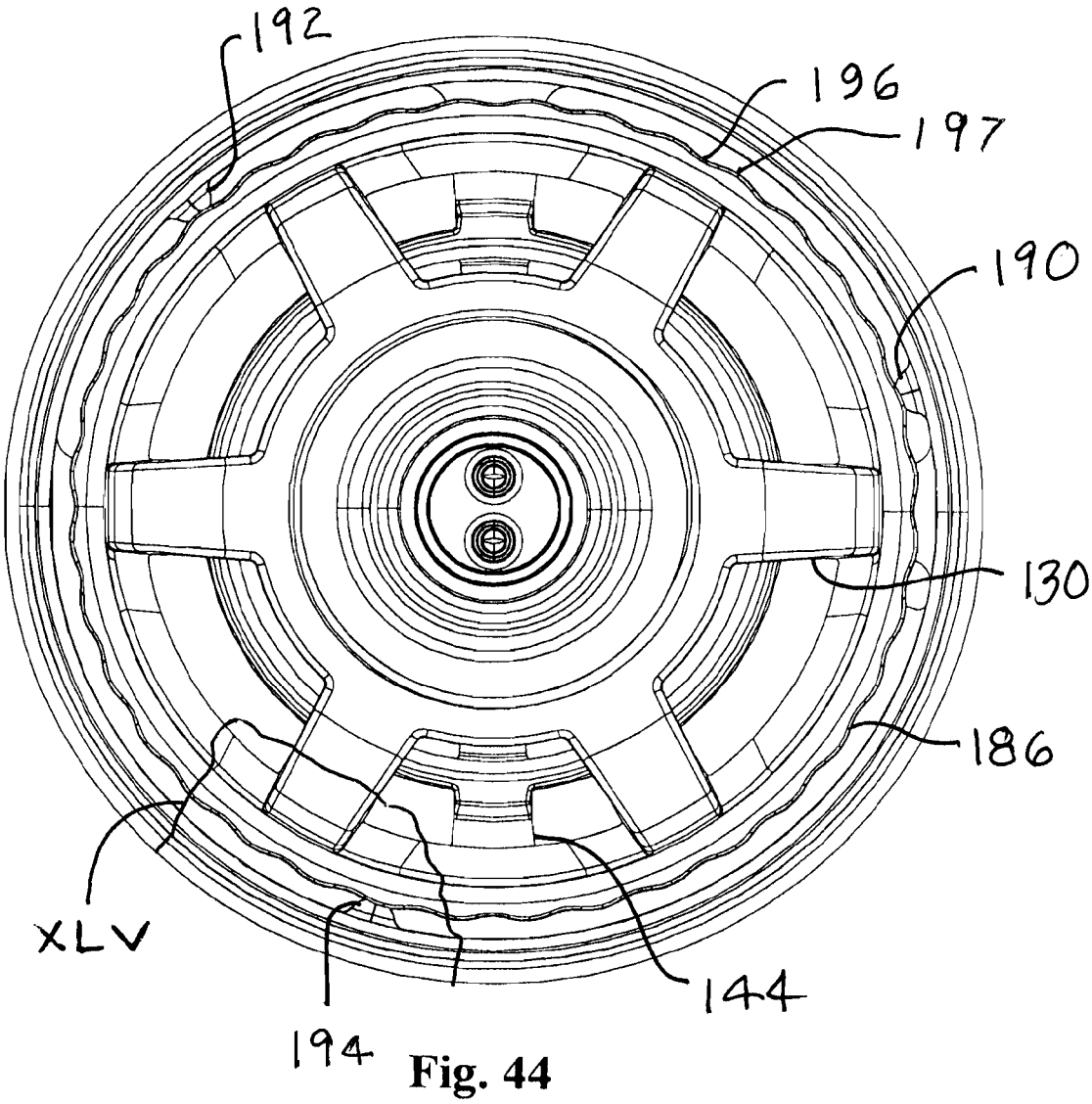
FIG. 44 is a rear elevation view of the spray tip assembly and locking nut.
Figure 45:
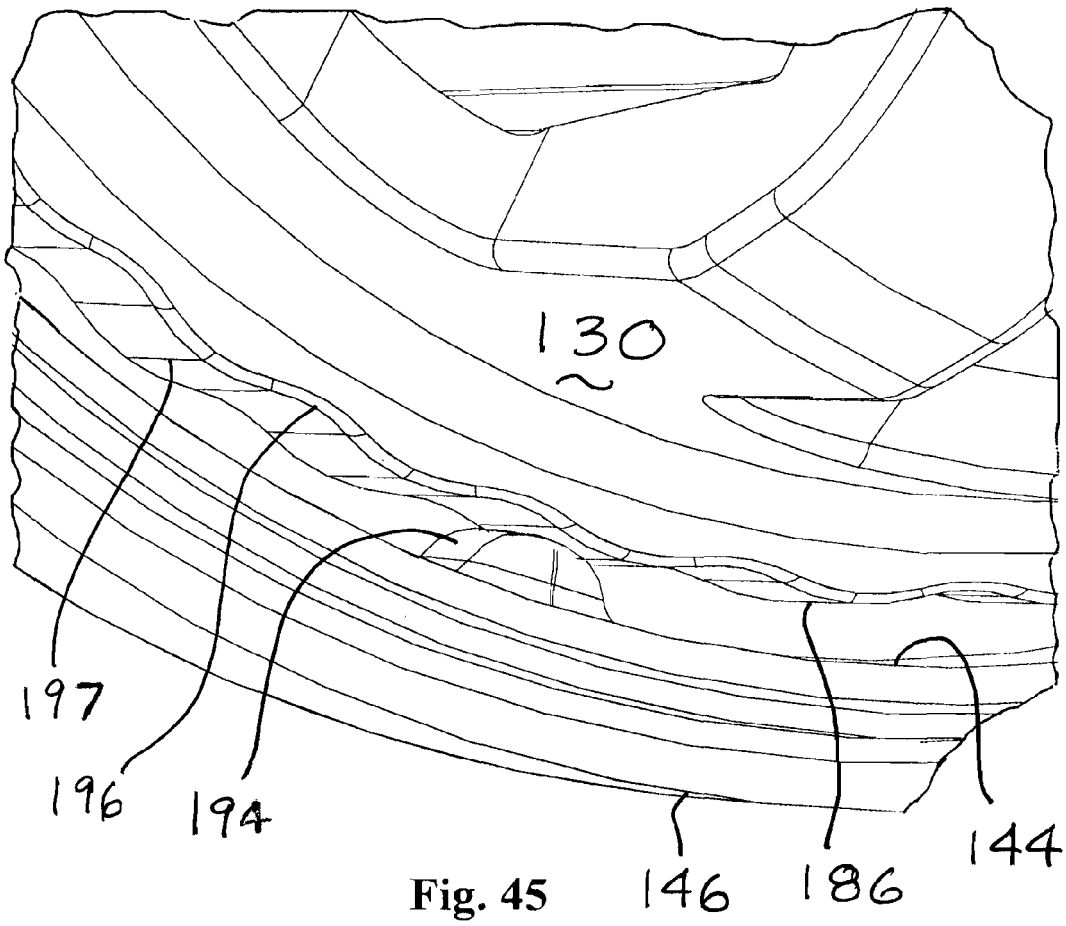
FIG. 45 is an enlarged perspective view of detail XLV of FIG. 44.

FIG. 38 shows the relationship of the locking nut 130 and the spray tip assembly 132 when these parts are assembled together (as shown in FIG. 29). FIGS. 39, 40 and 41 each show section views of the locking nut 130 and spray tip assembly 132 in the assembled condition. Locking nut 130 has a corrugated surface 186 at a forward end 187 thereof. As may be seen in FIGS. 32, 33, 40 and 44, frame 144 has a plurality (preferably three) radially inwardly directed protrusions 190, 192 and 194 which are sized and located to engage the corrugated surface 186. As may be seen most clearly in FIG. 44, the plurality of protrusions 190, 192 and 194 are spaced apart circumferentially from each other and with respect to the spacing of undulations or waves forming the corrugated surface 186 such that only one protrusion at a time is nested in a valley or trough 196 of the corrugated surface 186, while the remaining protrusions contact the corrugated surface at a slope between a trough and a crest or ridge 197 of the corrugated surface 186. More specifically with a plurality of three protrusions, one protrusion will come to rest in a valley 196, while one other protrusion will rest on an upward slope between a trough 196 and a crest 197, and the third protrusion will rest on a downward slope between a crest 197 and a trough 196. The interengagement of the protrusions and corrugated surface provide a form of increased frictional contact between the locking nut 130 and the frame 144 to provide additional security to prevent inadvertent loosening of the frame 144 (and therefore the nozzle head 150) when a user rotates the spray tip guard 146 (in an unthreading direction) to rotationally position the fan pattern to a desired orientation.

It is to be understood that having the misalignment mentioned above such that only one protrusion rests in a valley at any given position, the resolution of the detent mechanism of the protrusions and corrugated surface is multiplied (in the embodiment shown, by three times) over the resolution that would be obtained with all protrusions nesting simultaneously. This principle can be demonstrated by a system having two projections, one positioned to be in a trough when the other is positioned to be on a crest of the corrugated surface. As the projections are moved relative to the corrugated surface, one complete "resolution cycle" will move the first projection from the trough over an adjacent crest and into the next trough. During this cycle, there will be two detent rest positions, one at the start of the cycle with the first projection in the first trough and one half way through with the second projection in a trough. The resolution cycle is completed when the first projection is received in the next trough. During this resolution cycle there are two rest positions, increasing the resolution by two times that which would be obtained by both projections resting in troughs simultaneously. It is to be understood that this aspect of the present invention may be practiced with two, three or more protrusions engaging a corrugated surface in the manner described above.

In addition to the increase in the detent resolution described above, interengagement of the protrusions 190, 192 and 194 with the corrugated surface 186 provide a tactile feedback to a user who rotates the guard 146 past the end of the rotational range of travel between the frame 144 and guard 146 in an unthreading direction. During the motion within the rotational range of travel between the frame and guard, the frame 144 remains stationary with respect to the corrugated surface 186 on the locking nut 130. Once a user drives the guard 146 past the end of the rotational range of travel between the frame 144 and the guard 146 (in either direction), the protrusions 190, 192 and 194 will move over the corrugated surface 186, providing audible and tactile detent-type feedback to a user that the nozzle head 150 is rotating with respect to the cylinder 60'. The detent-type feedback informs the user that the nozzle head is threading or unthreading with respect to the cylinder and thus assists a user in proper assembly and disassembly of the paint spray gun 30'.

Figure 36:
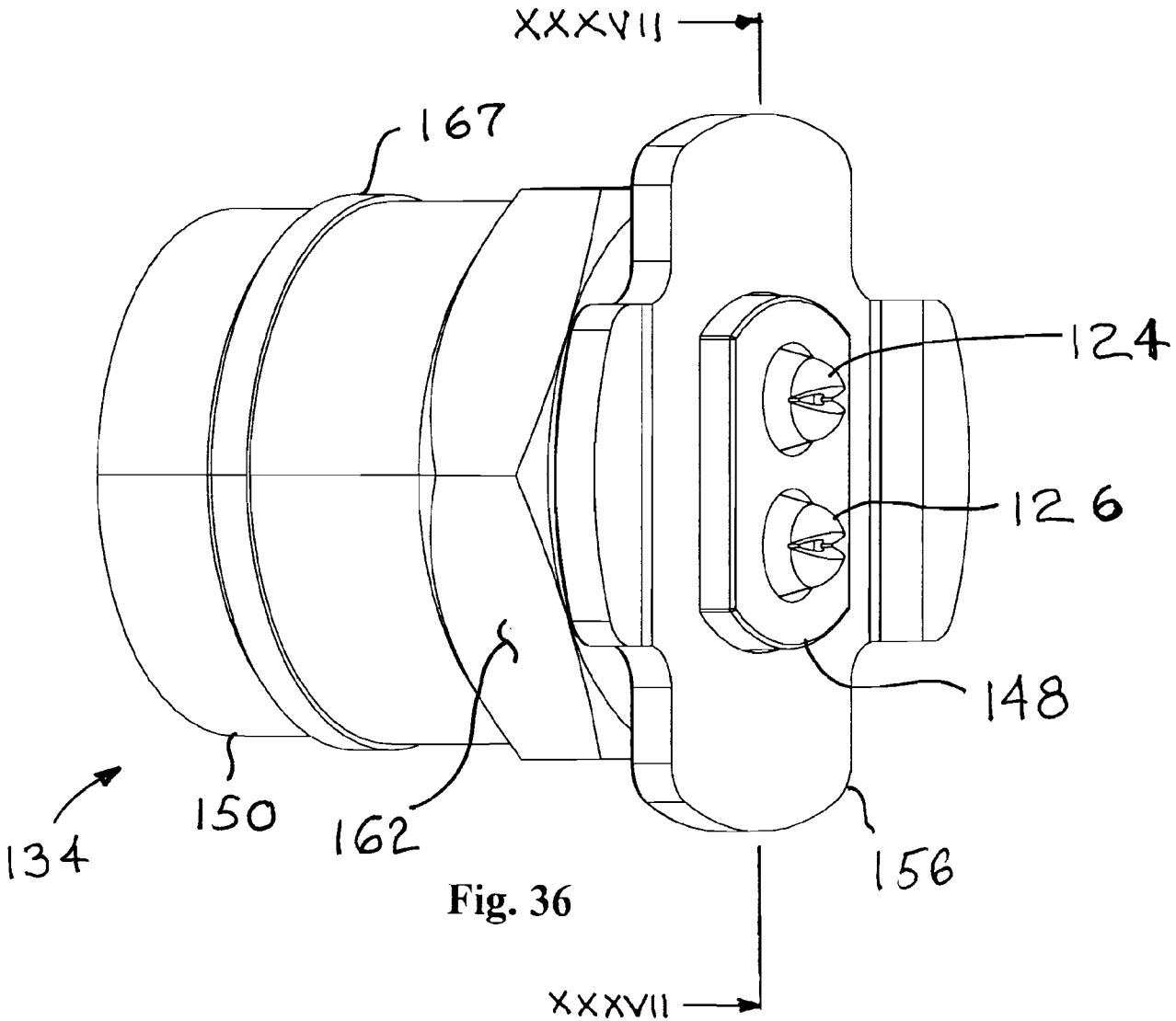
FIG. 36 is a perspective view from the side and front of a spray tip holder subassembly from the spray tip assembly of FIG. 30.
Figure 37:
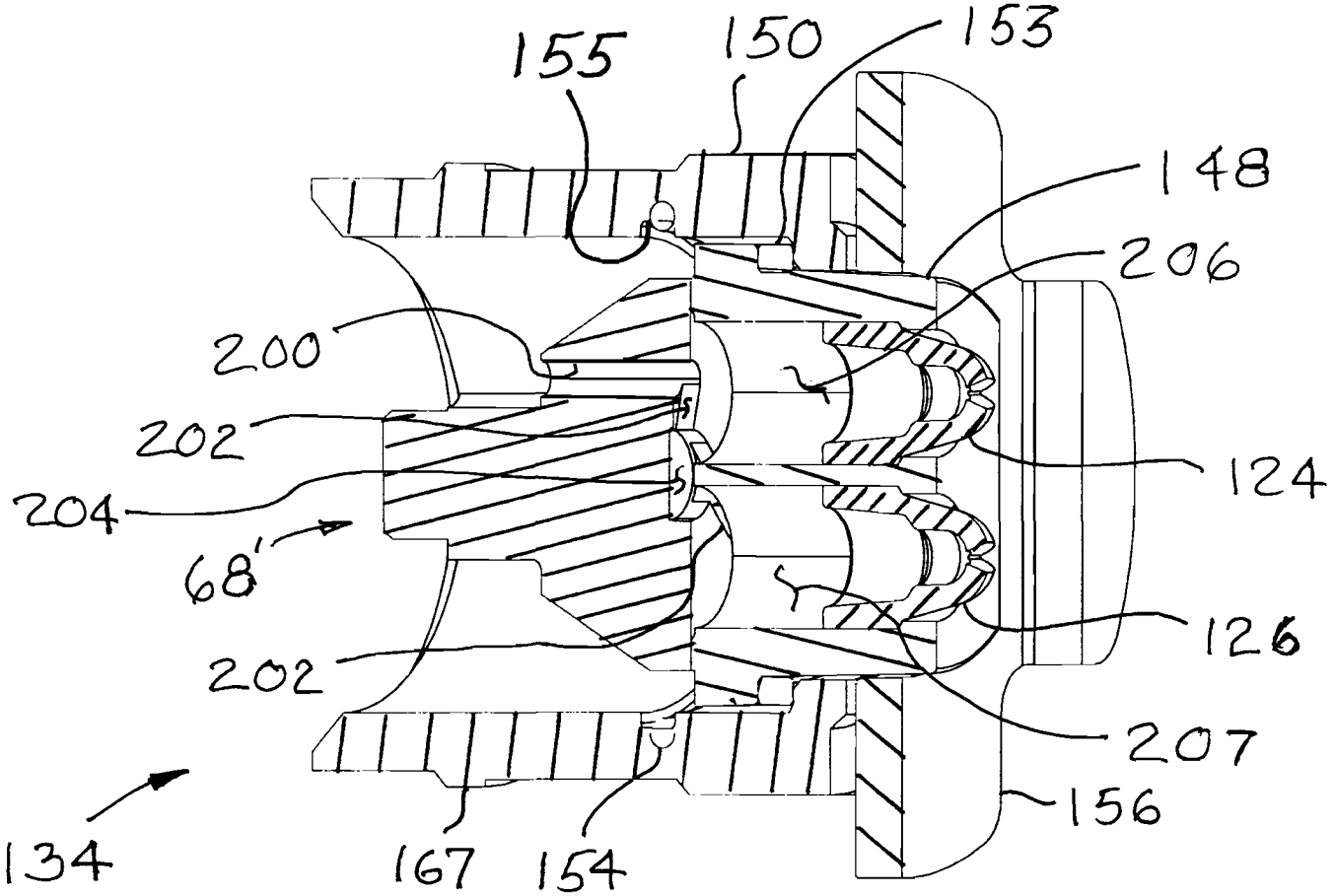
FIG. 37 is a section view from the side and front of the spray tip holder subassembly of FIG. 36 taken along line XXXVII-XXXVII of FIG. 36.

Referring now to FIGS. 35, 36, 37 and 42, various details of the spray tip subassembly 134 and associated parts may be seen. FIG. 36 shows a perspective view from the side of the subassembly 134 and key 156. FIG. 37 shows a corresponding section view (including a front portion of the swirl valve 68' inside the nozzle head 150). It is to be understood that in the practice of the present invention, key 156 is molded into the spray tip guard 146, but is shown independently in FIGS. 36 and 37 to illustrate the interrelationship of the key 156 and the tip holder 148. Because the projection 160 on tip holder 148 is received in the aperture 158 of the key 156 when parts are assembled, a user may rotate the tip holder 148 by rotating the spray tip guard 146, to obtain a desired orientation for the fan pattern delivered by the spray tips 124 and 128. Polyacetal ring 153 provides a sliding seal between the tip holder 148 and the nozzle head 150, and snap ring 154 retains the tip holder 148 in nozzle head 150. Ring 153 also reduces friction between the tip holder 148 and the nozzle head 150, allowing easier rotation by a user of the fan pattern emitted by the spray tip subassembly 134.

In operation, the coating material (such as paint) passes through a plurality of bores 200 as delivered by the piston 82' advancing in cylinder 60'. The coating material is directed from the bores 200 along respective channels 202 to a central swirl chamber 204 after which it passes to a pair of antechambers 206, 207 immediately upstream of tips 124 and 126, respectively. The coating material then passes through tips 124 and 126 where it is atomized into respectively overlapping fan atomization patterns for application to a surface to be coated.

Figure 46:
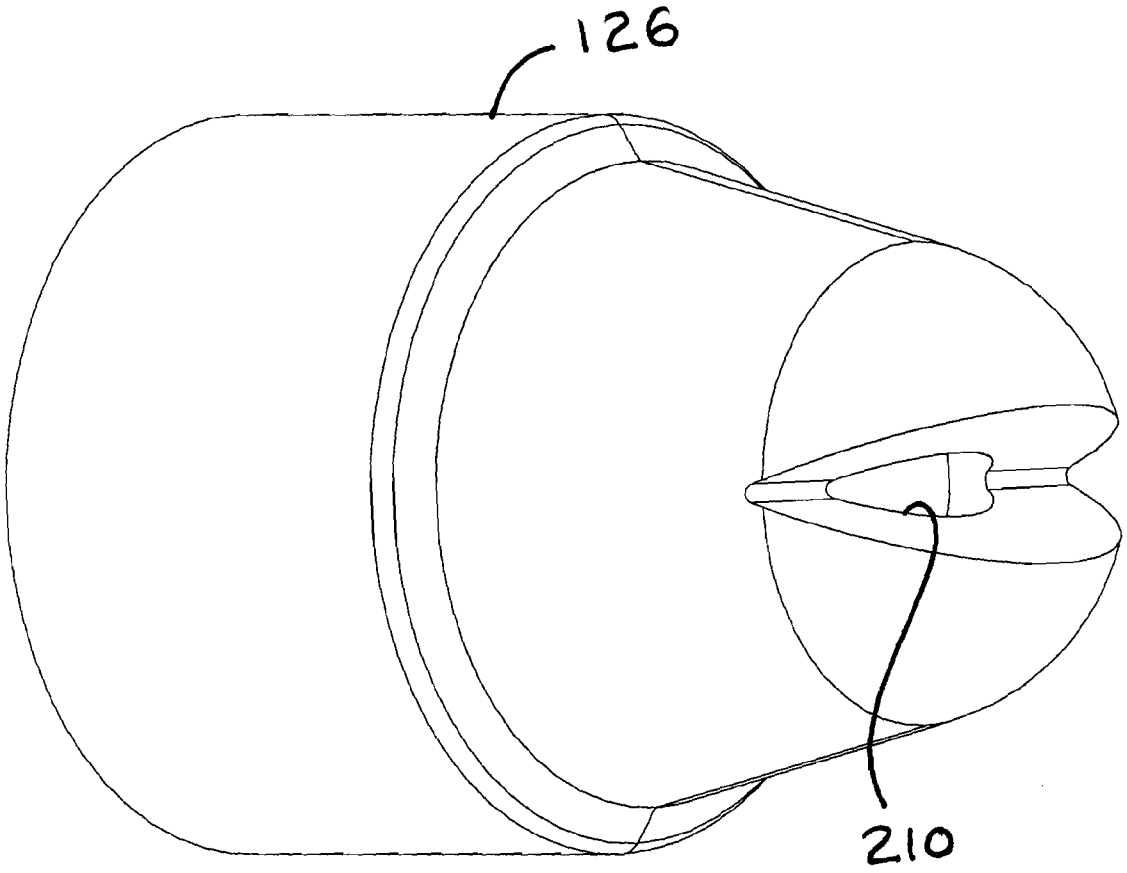
FIG. 46 is an enlarged perspective view of one embodiment of a spray tip useful in the practice of the present invention.
Figure 47:
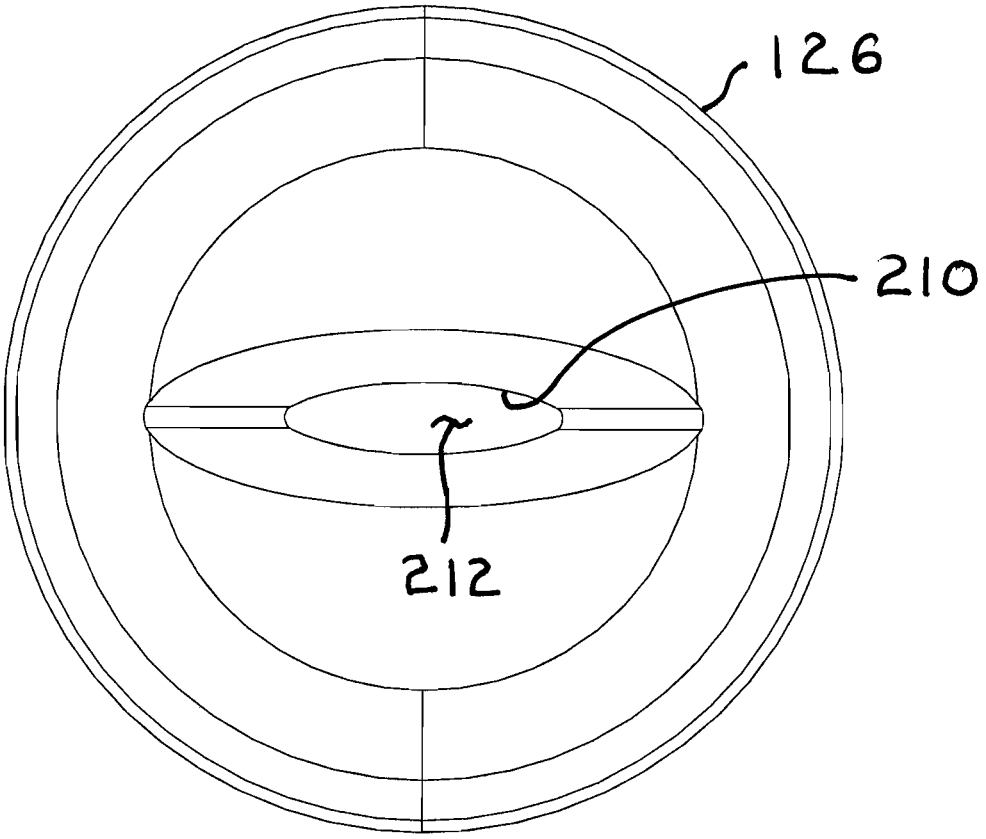
FIG. 47 is a front view of the spray tip of FIG. 46 illustrating a "cat-eye" orifice.

The theory of operation of the dual orifice spray tip cup gun is as follows. One prior art paint spray cup gun has a tip with a 0.8 mm diameter round tip, a 0.036" equivalent diameter ceramic tip or a 0.035" equivalent diameter carbide tip. Referring now to FIGS. 46 and 47, one way of characterizing the effective size of a tip such as spray tip 126 having a "cat eye" shaped orifice 210 (for producing a fan shaped spray pattern) is to equate the free area 212 of the orifice 210 of the tip 126 to the area of a circle with the same area, and then use the diameter of that circle with the same area to characterize the fan tip. For example, a 0.035" carbide tip has a free area of 0.000962 sq. in. The present invention has two tips with a total equivalent free area of 0.000962 sq. in. Each tip has an effective orifice diameter equal to the square root of four times the area of the orifices divided by pi, as expressed by the following equation (1).

$$D = \sqrt{\frac{4 * A}{\Pi}} \tag{1}$$

Since the area of one tip is ½ that of the total, if A=0.000481 inches, D=0.025 inches.

Atomization of paint and similar coating materials is achieved by creating a high pressure differential across an orifice. The edge of the orifice shears the paint into ribbons, thereby creating unstable streamers of paint with a given thickness. Utilizing two orifices increases the shearing surface by approximately 39%. More shearing surface increases the efficiency of the orifice assembly. Also, the extruded ribbons of paint are thinner and result in smaller, more evenly sized particles since the width of the largest section of the opening is smaller, as predicted by the Plateau-Rayleigh Instability, named after Joseph Plateau and Lord Rayleigh. In 1873, Plateau found experimentally that a vertically falling stream of water will break up into drops if its length is greater than about 3.13 to 3.18 times its diameter. Later, Lord Rayleigh showed theoretically that a vertically falling column of non-viscous liquid with a circular cross-section should break up into drops if its length exceeded its circumference, or pi times its diameter. In the practice of the present invention, the operation is not adversely affected since the effective orifice size of the assembly (two orifices) is the same as a single orifice.

Relatively smaller particles ("fines") are created in greater numbers at the shearing edge of the orifice and manifest themselves on the target (i.e., the surface to be coated) in approximately the same orientation as the shape of the orifice . . . a cat-eye or oval shaped pattern. In addition, more fines are generated where the two opposing arcs of the orifice slit (or cat eye opening) connect. The converging edges approaching the intersection of the arcs have a greater ratio of fine-creating shearing edge relative to area of the gap between the edges, therefore the edge regions of the generated spray pattern contain more fine particles than does the central region.

Each tip axis may be oriented such that there is an included angle of between zero and about 3 degrees between them. The resulting impingement of the two colliding fan-shaped patterns of atomized coating material (such as paint) tends to reduce the number of uncontrolled fine particles, coalescing the fines into larger or more averaged sized particles. Also, this arrangement of two tips in the present invention greatly reduces the generation and deposition of (uncombined) fine particles in the periphery of the pattern. The full coat coverage area (i.e., the "umbra") remains the same, but the fade width ("penumbra" width) is reduced and the fines found within the fade area ("penumbra") is greatly reduced. By increasing the shearing efficiency and colliding the fines back into the shared volume of the two fan patterns, the control and placement of the particles within the resulting atomization pattern is greatly improved.

Prior to delivering the coating material (such as paint) to the orifices of the tips in the practice of the present invention, rotation of the material is induced via a swirl valve or device. The resulting rotational momentum in the coating material as it travels through and exits each orifice imparts centrifugal forces on the extruded ribbon of coating material further inducing instabilities resulting in flaring the atomization pattern in an outward (somewhat flattened cone shaped) direction.

Figure 48:
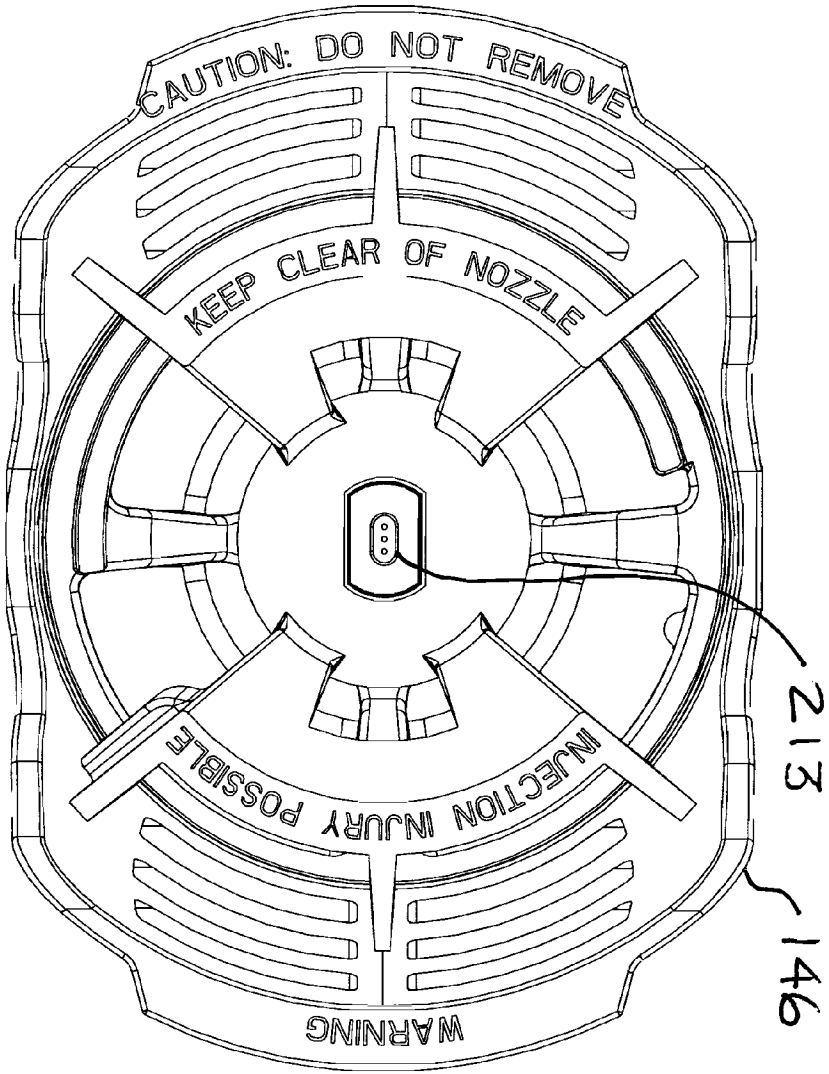
FIG. 48 is a front view of the spray tip guard with an alternative embodiment of a three aperture spray tip having round orifices for atomizing coating material in the practice of the present invention.
Figure 49:
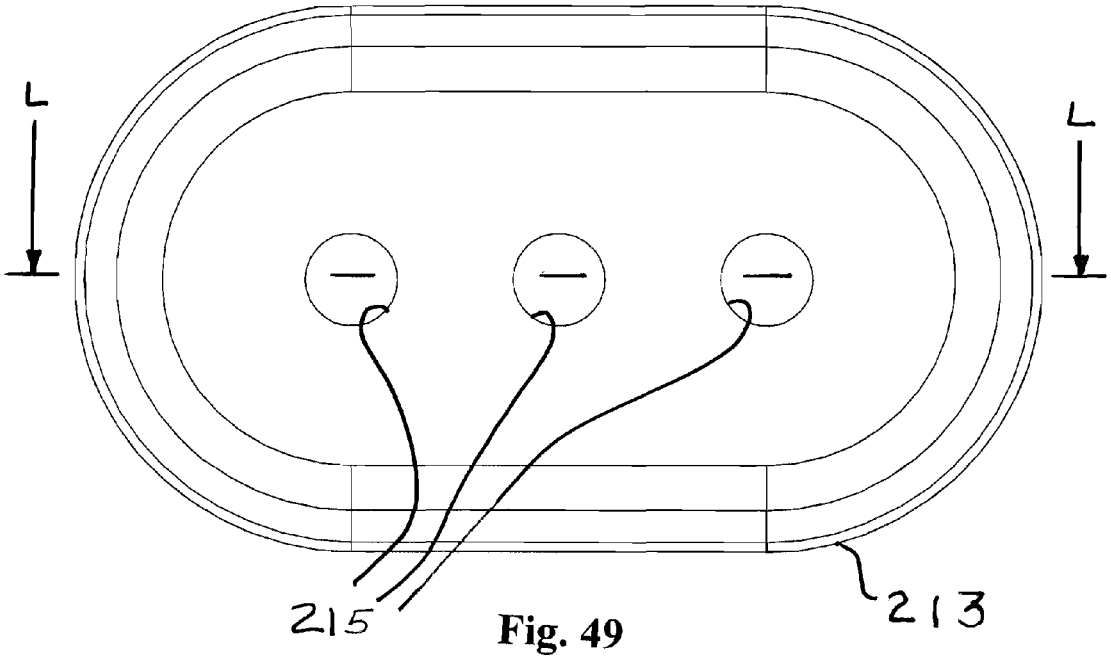
FIG. 49 is an enlarged front view of the spray tip from FIG. 48.
Figure 50:
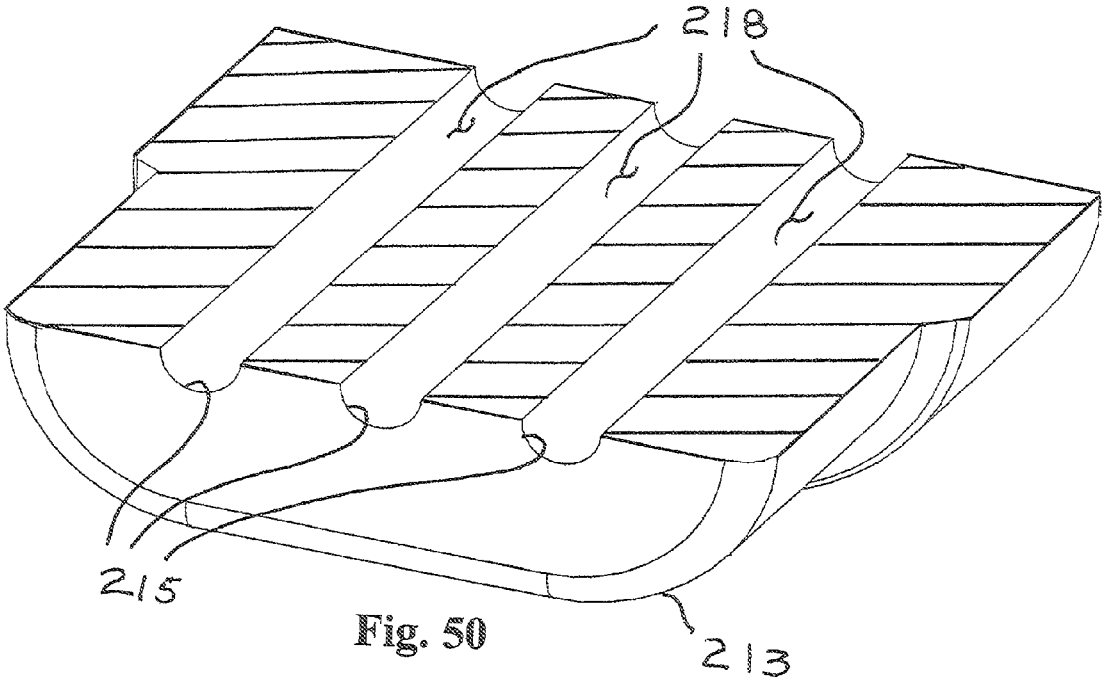
FIG. 50 is a perspective view of the spray tip of FIG. 49, sectioned along line L-L of FIG. 49.

Referring now to FIGS. 48, 49, and 50, a further alternative embodiment of a spray tip 213 useful in the practice of the present invention may be seen. Spray tip 213 has a plurality of round apertures 215, each of which deliver a cone-shaped atomization pattern. It is to be understood that the atomization patterns emitted from the apertures 215 will overlap each other.

FIG. 48 shows the spray tip 213 in the spray tip guard 146. FIG. 49 shows an enlarged front view of the spray tip 213 with the three apertures 215. FIG. 50 is a perspective view of the spray tip 213 sectioned along line L-L of FIG. 49 showing that the three apertures 215 are connected to parallel cylindrical bores 218. It is to be understood that an alternative tip (not shown) having only two bores 218 may be used in the practice of the present invention, and that the bores 218 (whether two or three) can be angled as are the centerlines 120, 122 of the cat-eye tips, (if desired) as an alternative to being parallel. It is to be further understood that each of the bores 218 may be of non-uniform diameter behind its respective aperture 215. Each bore 218, however, provides fluid communication from a swirl chamber (such as swirl chamber 204 shown in FIG. 37) to its respective aperture 215.

The invention is not to be taken as limited to all of the details thereof as modifications and variations thereof may be made without departing from the spirit or scope of the invention; accordingly,

What is claimed is:

1. A hand-held paint spray gun apparatus comprising:

a gun body having a reciprocating motor;

a cylinder having an inlet connected to a source of paint and an outlet;

a reciprocating piston received in the cylinder and driven by the reciprocating motor pressurizing paint in the cylinder;

a swirl valve located downstream of the outlet of the cylinder and piston, the swirl valve imparting swirling motion in the paint; and a spray tip subassembly mounted on the gun downstream of the swirl valve, wherein the spray tip subassembly has a plurality of apertures that are simultaneously in fluid communication with the swirl valve such that each of the plurality of apertures simultaneously emit a paint spray pattern having a centerline, where the centerlines of the paint spray patterns are generally parallel to each other such that the spray patterns overlap downstream from the apertures.

2. The apparatus of claim 1 wherein the centerlines of the spray patterns converge towards each in an acute convergence angle as the spray patterns exit from the apertures.

3. The apparatus of claim 2 wherein the convergence angle is between about 2 degrees and about 5 degrees.

4. The apparatus of claim 2 wherein the convergence angle is about 3 degrees.

5. The apparatus of claim 1 wherein the centerlines of the spray patterns diverge at an acute divergence angle.

6. The apparatus of claim 5 wherein the divergence angle is between about 2 degrees and about 5 degrees.

7. The apparatus of claim 5 wherein the divergence angle is about 3 degrees.

8. The apparatus of claim 1 wherein the spray patterns are cone-shaped.

9. The apparatus of claim 1 wherein the spray patterns are fan shaped.

10. The apparatus of claim 1 wherein the spray tip subassembly has a pair of apertures.

11. The apparatus of claim 1 wherein the spray tip subassembly comprises a single material forming a pair of spray tips.

12. The apparatus of claim 11 wherein the material comprises a ceramic material.

13. The apparatus of claim 11 wherein the material comprises a carbide material.

14. The apparatus of claim 1 wherein the spray tip subassembly comprises a pair of inserts, each insert having an aperture and wherein both inserts are received in a holder.

15. The apparatus of claim 14 wherein each of the inserts comprises a ceramic material.

16. The apparatus of claim 14 wherein each of the inserts comprises a carbide material.

17. The apparatus of claim 1 wherein the swirl valve has an outlet and the spray tip subassembly has an inlet, the apparatus further comprising a swirl chamber adapter positioned between the outlet of the swirl valve and the inlet of the spray tip subassembly, wherein the adapter has a generally planar face opposing the swirl valve and the swirl chamber adapter forms a swirl chamber upstream of the spray tip subassembly and further wherein the swirl chamber adapter includes a centrally located bore extending through the generally planar face of the swirl chamber adapter to deliver the paint from the swirl chamber to the spray tip subassembly.

18. The apparatus of claim 1 wherein the swirl valve further comprises a pair of outlet recesses aligned with inlet apertures in the spray tip subassembly, the pair of outlet recesses providing a pair of swirl chambers between the swirl valve and the spray tip subassembly.

19. A hand-held paint spray gun apparatus comprising:

a gun body having a reciprocating motor;

a cylinder having an inlet connected to a source of paint and an outlet;

a reciprocating piston received in the cylinder and driven by the reciprocating motor pressurizing paint in the cylinder and delivering the pressurized paint to the outlet;

a swirl valve located downstream of the outlet, and imparting swirling motion in the paint; and a pair of atomizing apertures located downstream of and in fluid communication with the swirl valve, wherein each atomizing aperture has a cat-eye cross section, each emitting a generally fan shaped spray pattern at the same time, with each atomizing aperture characterized by a primary axis extending transversely across the respective aperture wherein the primary axes of the atomizing apertures are generally parallel to each other and further wherein the fan shaped spray patterns overlap each other downstream from the atomizing apertures.

20. The apparatus of claim 19 wherein each of the pair of atomizing apertures is formed in a spray tip carried in a holder permitting rotation of the spray tip even when the when the holder is secured to the outlet against leakage.

21. The apparatus of claim 20 wherein the holder permits rotation of the spray tip without rotation of a retaining nut.

22. The apparatus of claim 20 wherein the holder is rotatable within a nozzle head.

23. The apparatus of claim 22 wherein the nozzle head is retained within a spray tip frame.

24. The apparatus of claim 23 further comprising a spray tip guard and a key secured to the spray tip guard, wherein the key has a non-circular aperture closely interfitting a corresponding non-circular projection on the holder such that the holder and spray tips can be rotated by rotating the spray tip guard.

25. The apparatus of claim 24 wherein the spray tip guard has a limited range of rotation with respect to the spray tip frame.

26. The apparatus of claim 25 further comprising a locking nut retaining the cylinder to the reciprocating motor, and wherein one of the locking nut and spray tip frame has a corrugated surface and the other of the locking nut and the spray tip frame has a plurality of protrusions engaging the corrugated surface.

27. The apparatus of claim 26 wherein the individual protrusions are spaced apart circumferentially from each other and wherein the corrugated surface has a plurality of troughs and crests, such that only one protrusion at a time is in a trough of the corrugated surface.

28. The apparatus of claim 27 wherein the plurality of protrusions comprise three protrusions.

29. A hand-held paint spray gun apparatus comprising:

a gun body having a reciprocating motor;

a cylinder having an inlet connected to a source of paint and an outlet;

a reciprocating piston received in the cylinder and driven by the reciprocating motor pressurizing paint in the cylinder;

a swirl valve located downstream of the outlet of the cylinder and piston, the swirl valve imparting swirling motion in the paint; and a plurality of atomizing orifices mounted on the gun downstream of the swirl valve and in fluid communication with the swirl valve, with each orifice simultaneously emitting an atomized spray pattern having an outer peripheral region with at least some particles in the atomized spray pattern and wherein the atomized spray patterns overlap one another such that particles in the atomized spray patterns recombine in the atomized spray patterns.

* * * * *